US011789387B2

(12) United States Patent
Kurata et al.

(10) Patent No.: US 11,789,387 B2
(45) Date of Patent: Oct. 17, 2023

(54) IMAGE FORMING APPARATUS

(71) Applicant: CANON KABUSHIKI KAISHA, Tokyo (JP)

(72) Inventors: Munehito Kurata, Shizuoka (JP); Keisuke Mochizuki, Shizuoka (JP); Tetsuichiro Fujimoto, Shizuoka (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 17/951,237

(22) Filed: Sep. 23, 2022

(65) Prior Publication Data

US 2023/0037748 A1 Feb. 9, 2023

Related U.S. Application Data

(63) Continuation of application No. 17/372,768, filed on Jul. 12, 2021, now Pat. No. 11,487,228.

(30) Foreign Application Priority Data

Jul. 15, 2020 (JP) ..... 2020-121234
Aug. 11, 2020 (JP) ..... 2020-135964

(51) Int. Cl.
*G03G 15/20* (2006.01)
*G03G 15/00* (2006.01)

(52) U.S. Cl.
CPC ..... *G03G 15/2028* (2013.01); *G03G 15/2039* (2013.01); *G03G 15/5029* (2013.01)

(58) Field of Classification Search
None
See application file for complete search history.

(56) References Cited

U.S. PATENT DOCUMENTS 11,487,228 B2 * 11/2022 Kurata ..... G03G 15/5029
2003/0235420 A1 12/2003 Fujiwara
2009/0052955 A1 2/2009 Tatematsu et al.
(Continued)

FOREIGN PATENT DOCUMENTS

JP 2010019870 A 1/2010
JP 2016102861 A 6/2016

OTHER PUBLICATIONS

Office Action issued in U.S. Appl. No. 17/372,768 dated Mar. 21, 2022.

(Continued)

*Primary Examiner* — Sevan A Aydin
(74) *Attorney, Agent, or Firm* — ROSSI, KIMMS & MCDOWELL LLP

(57) ABSTRACT

An image forming apparatus includes a control unit configured to execute a first mode and a second mode. The first mode is a mode in which a toner image is formed on a sheet at a time when a sheet passes through an image formation position for a first time after detecting a property of the sheet by a detection unit. Wherein the second mode is a mode in which a toner image is not formed on a sheet at the time when the sheet passes through the image formation position for the first time after detecting the property of the sheet by the detection unit and is formed on the sheet at a time when the sheet is conveyed via the second conveyance path and passes through the image formation position for a second time.

9 Claims, 9 Drawing Sheets

(56) References Cited

U.S. PATENT DOCUMENTS

| | | | |
|---|---|---|---|
| 2009/0208236 | A1 | 8/2009 | Katsura et al. |
| 2016/0320748 | A1 | 11/2016 | Toyoizumi et al. |
| 2019/0018352 | A1 | 1/2019 | Shiokawa et al. |

OTHER PUBLICATIONS

Notice of Allowance issued in U.S. Appl. No. 17/372,768 dated Jun. 29, 2022.

* cited by examiner

IMAGE FORMING APPARATUS

BACKGROUND OF THE INVENTION

Field of the Invention

This invention relates to an image forming apparatus forming an image on a sheet.

Description of the Related Art

Generally, an image forming apparatus, such as a laser printer, fixes a toner image on a sheet by heating and pressing the toner image after transferring the toner image formed on a photosensitive member onto the sheet. In such an image forming apparatus, appropriate fixing conditions at a time of fixing the toner image on the sheet changes depending on properties of the sheet. The fixing conditions of the toner image in the image forming apparatus include, for example, a temperature, a sheet conveyance speed, and the like at the time of fixing the toner image. Further, for example, the properties of the sheet include a grammage, a surface property, and the like.

In such an image forming apparatus, if the toner image is not fixed under the appropriate fixing conditions corresponding to the property of the sheet, fixing defects in which the toner image is not adequately fixed on the sheet occur in some cases. For example, since a heat capacity is also large for a large grammage sheet, if the toner image is fixed on the large grammage sheet under the same fixing conditions as a small grammage sheet, in some cases, a quantity of heat provided to a toner is insufficient, and the toner image is not adequately fixed on the sheet.

Hitherto, an image forming apparatus capable of suppressing the fixing defects by detecting the grammage of the sheet and decelerating a sheet conveyance speed in a case of the large grammage sheet is disclosed (refer to Japanese Patent Laid-Open No. 2016-102861). Having detected the grammage of the sheet, the image forming apparatus described in Japanese Patent Laid-Open No. 2016-102861 stops a sheet conveyance once before forming the image on the sheet. Further, the image forming apparatus described in Japanese Patent Laid-Open No. 2016-102861 decelerates rotation of a photosensitive drum during a stop of the sheet conveyance in a case where the detected grammage is large, and resumes the sheet conveyance at a small sheet conveyance speed corresponding to deceleration of the photosensitive drum. Herewith, the image forming apparatus described in Japanese Patent Laid-Open No. 2016-102861 suppresses the fixing defects of the toner image by fixing the toner image on the large grammage sheet at the conveyance speed smaller than the conveyance speed of the small grammage sheet.

However, in the image forming apparatus described in Japanese Patent Laid-Open No. 2016-102861, since it is necessary to individually control acceleration and deceleration of the photosensitive drum and each roller for the sheet conveyance independently, a processing load of a control unit is large.

SUMMARY OF THE INVENTION

According to a first aspect of the present invention, an image forming apparatus includes a conveyance unit configured to convey a sheet, a first conveyance path on which the sheet is conveyed by the conveyance unit, a detection unit configured to detect a property of the sheet conveyed along the first conveyance path, an image forming unit configured to form an unfixed toner image onto the sheet detected by the detection unit at an image formation position on the first conveyance path, a fixing unit configured to fix the toner image on the sheet by heating and pressing the sheet on which the toner image is formed by the image forming unit, a second conveyance path branching from the first conveyance path at a position downstream of the fixing unit in a sheet conveyance direction and joining the first conveyance path at a position upstream of the image forming unit in the sheet conveyance direction, and a control unit configured to execute a first mode and a second mode. The first mode is a mode in which a toner image is formed on a sheet at a time when the sheet passes through the image formation position for a first time after detecting the property of the sheet by the detection unit. Wherein the second mode is a mode in which a toner image is not formed on a sheet at the time when the sheet passes through the image formation position for the first time after detecting the property of the sheet by the detection unit and is formed on the sheet at a time when the sheet is conveyed via the second conveyance path and passes through the image formation position for a second time.

According to a second aspect of the present invention, an image forming apparatus includes a conveyance unit configured to convey a sheet, an image forming unit configured to form an unfixed toner image onto the sheet conveyed by the conveyance unit, a fixing unit configured to fix the toner image on the sheet by heating and pressing the sheet on which the toner image is formed by the image forming unit, a detection unit configured to detect a property of the sheet conveyed by the conveyance unit, and a control unit configured to change, based on a detection result of the detection unit, a sheet conveyance speed among a plurality of conveyance speeds including a first conveyance speed and a second conveyance speed that is slower than the first conveyance speed. The control unit is configured to control the conveyance unit such that the conveyance unit starts to convey a second sheet in an image forming job at a conveyance speed corresponding to a property of a first sheet detected by the detection unit, and the conveyance unit starts to convey the first sheet in an image forming job at a predetermined conveyance speed faster than the second conveyance speed after a delay time has been elapsed from the fixing unit reached a target temperature.

Further features of the present invention will become apparent from the following description of exemplary embodiments with reference to the attached drawings.

DESCRIPTION OF THE EMBODIMENTS

Hereinafter, an image forming apparatus of each embodiment will be described with reference to drawings. It is to be understood that a scope of this disclosure is not limited by sizes, materials, shapes, relative arrangements, and the likes of components described in the embodiments unless otherwise specifically stated.

First Embodiment

Schematic Configuration of Image forming Apparatus

Figure 1:
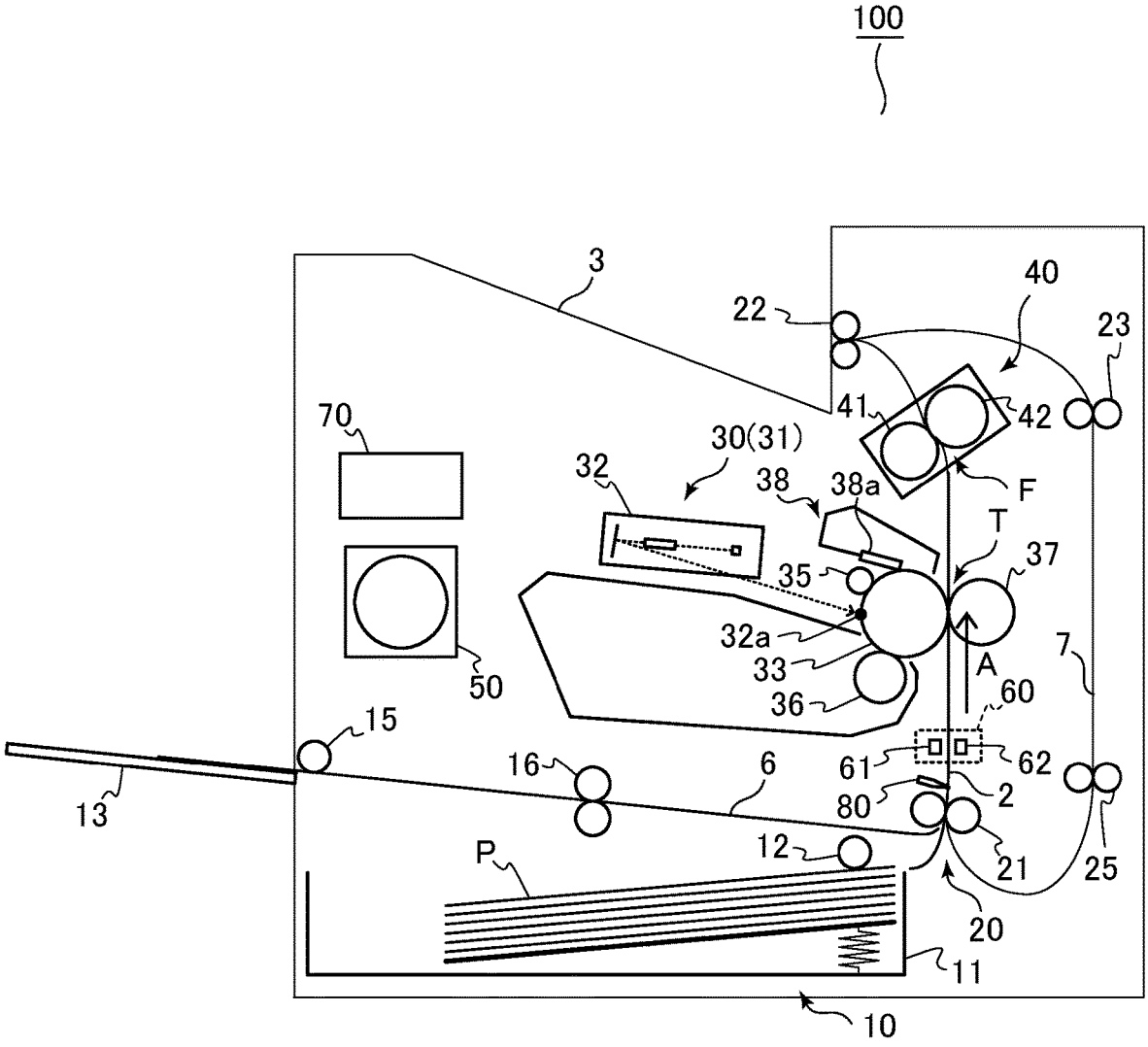
FIG. 1 is a schematic drawing of an image forming apparatus relating to a first embodiment.

FIG. 1 is a schematic drawing showing an image forming apparatus 100 relating to a first embodiment. In this embodiment, the image forming apparatus 100 which is a laser beam printer of an electrophotographic system forming an image on a sheet (recording material) will be described as an example. To be noted, as the sheet, it is possible to use various kinds of sheets different in sizes and materials including, but not limited to, paper such as standard paper and thick paper, a plastic film, cloth, various kinds of sheet material applied with surface treatment such as coated paper, and specially shaped sheets such as an envelope and an index paper.

The image forming apparatus 100 includes a sheet feeding unit 10, a sheet conveyance apparatus 20 conveying the sheet, an image forming unit 30 forming a toner image on the sheet, a fixing unit 40 fixing the toner image on the sheet, a motor 50, and a control unit 70. Further, the image forming apparatus 100 includes a sheet sensor 80 detecting a conveyed sheet, and a media sensor 60 detecting a property of the conveyed sheet.

The sheet feeding unit 10, serving as a feeding unit, is disposed in a detachable manner from an apparatus body, and includes a feed cassette 11 stacking and storing the sheet P, and a feed roller 12 feeding the sheet stored in the feed cassette 11, serving as a sheet stacking unit. The feed roller 12, serving as a feeding unit, feeds the sheet P stored in the feed cassette 11 by separating the sheet into one sheet at a time in a manner that rotates while coming into contact with an uppermost sheet of the sheets.

Further, the sheet feeding unit 10 includes a manual feed tray 13, serving as the sheet stacking unit, capable of supporting the sheet in a stacking manner, and feed rollers 15 and 16 feeding the sheet supported by the manual feed tray 13. The feed roller 15, serving as the feeding unit, separates the sheet into one sheet at a time by rotating while coming into contact with an uppermost sheet of the sheets P supported by the manual feed tray 13, and feeds the sheet with the feed roller 16, serving as the feeding unit.

The sheet conveyance apparatus 20, serving as a conveyance unit, includes a conveyance roller pair 21, a sheet discharge roller pair 22, and inverse conveyance roller pairs 23 and 25. The conveyance roller pair 21 is constituted by two rollers which rotate facing each other, and conveys the sheet by nipping in a nip portion formed between these two rollers along a sheet conveyance path 2, serving as a first conveyance path. The sheet discharge roller pair 22 and the inverse conveyance roller pairs 23 and 25 will be described later.

The image forming unit 30, serving as an image forming unit, includes a photosensitive drum 33, a charge roller 35, a laser scanner 32, a developing roller 36, a transfer roller 37, and a cleaning apparatus 38. In this embodiment, the photosensitive drum 33, the charge roller 35, the developing roller 36, and the cleaning apparatus 38 are disposed detachably from the apparatus body of the image forming apparatus 100 as a process cartridge 31.

The photosensitive drum 33, serving as an image bearing member, rotates in a counter-clockwise direction in FIG. 1. The charge roller 35, serving as a charge unit, uniformly charges (primary charge) a circumferential surface of the photosensitive drum 33 to a predetermined polarity and electric potential by applying a charge voltage. The laser scanner 32, serving as an exposing unit, outputs an ON/OFF modulated laser beam corresponding to a chronological order electric digital pixel signal of image information input from an external apparatus such as an image scanner and an external computer, not shown. The laser scanner 32 forms an electrostatic latent image on the circumferential surface of the photosensitive drum 33 corresponding to the input image information by scanning the circumferential surface of the photosensitive drum 33 while exposing with this laser beam and neutralizing a charge in an exposure bright section on the circumferential surface of the photosensitive drum 33.

The developing roller 36, serving as a developing unit, is disposed opposite the photosensitive drum 33, and, by rotating while bearing a toner (developer), supplies the toner to the circumferential surface of the photosensitive drum 33, and develops the electrostatic latent image formed on the circumferential surface of the photosensitive drum 33 as the toner image in sequence. In the image forming apparatus 100 of this embodiment, a reversal development system developing the electrostatic latent image by adhering the toner to the exposure bright section of the electrostatic latent image is used.

The transfer roller 37, serving as a transfer unit, is disposed opposite the photosensitive drum 33, and forms a transfer nip T with the photosensitive drum 33 downstream of the conveyance roller pair 21 in a sheet conveyance direction (arrow A direction in FIG. 1) on the sheet conveyance path 2. The transfer roller 37 electrostatically transfers the toner image formed on the circumferential surface of the photosensitive drum 33 to a surface of the sheet P, which is nipped and conveyed by the transfer nip T, by applying a transfer voltage of a reverse polarity of the toner. In other words, the transfer roller 37 transfers the toner image on the image bearing member to the sheet at the transfer nip portion T on the first conveyance path, and forms an unfixed toner image on the sheet. The cleaning apparatus 38 includes a cleaning blade 38*a*, and collects a residual toner, paper dust, and the like on the circumferential surface of the photosensitive drum 33 by the cleaning blade 38*a* after the toner image has been transferred to the sheet P.

To be noted, in this embodiment, while the image forming apparatus 100 employs a system of directly transferring the toner image from the photosensitive drum to the sheet, it is not limited to this, and acceptable to employ a system of transferring the toner image formed on the photosensitive drum to the sheet via an intermediate transfer member such as an intermediate transfer belt.

The fixing unit 40, serving as a fixing unit, includes a rotary member 42, serving as a fixing member, and a press roller 41, serving as a pressing member, facing the rotary member 42 across the sheet conveyance path 2 and forming a fixing nip F, serving as a nip portion, with the rotary member 42. The fixing nip F is disposed downstream of the transfer nip T in the sheet conveyance direction on the sheet conveyance path 2, and the fixing unit 40 fixes the toner image on the sheet by heating and pressing the nipped sheet at the fixing nip F. Details of the fixing unit 40 will be described later.

The sheet discharge roller pair 22 is disposed downstream of the fixing unit 40 on the sheet conveyance path 2. The sheet discharge roller pair 22 consists of two rollers which rotate facing each other, and discharges the sheet to a sheet discharge tray 3 by nipping and conveying the sheet with a nip portion formed between two rollers.

Between the conveyance roller pair 21 and the transfer nip T on the sheet conveyance path 2, that is, downstream of the conveyance roller pair 21 and upstream of the transfer nip T (image forming unit 30) in the sheet conveyance direction, the sheet sensor 80 and the media sensor 60 are disposed. The sheet sensor 80, for example, is configured by a transmission type optical sensor and the like, and outputs a detection signal when an optical path is blocked by the sheet conveyed with the conveyance roller pair 21.

The media sensor 60, serving as a detection unit, includes an output part 61 (transmitting part) outputting a sound wave (ultrasonic wave) toward the sheet and an input part 62 (receiving part) to which the sound wave is input, and the output part 61 and the input part 62 are disposed opposite each other across the sheet conveyance path 2. Configurations of the output part 61 and the input part 62 of the media sensor 60 are similar to each other, and each includes a pressure sensitive electric element (also called as a piezoelectric element) interconverting between mechanical displacement and an electric signal, and an electrode terminal.

In the output part 61, by inputting a pulse voltage of a predetermined frequency to the electrode terminal, the piezoelectric element oscillates to generate the sound wave, and the generated sound wave propagates in air. When the sound wave reaches the sheet on the sheet conveyance path 2, the sheet is vibrated by the sound wave. A vibration of the sheet propagates in the air as the sound wave, and reaches the input part 62. As described above, the sound wave generated at the output part 61 propagates to the input part 62 via the sheet. The piezoelectric element in the input part 62 generates an output voltage corresponding to an oscillation amplitude of the input sound wave at the electrode terminal. As for the frequency of the sound wave output by the output part 61, an appropriate frequency is set beforehand according to configurations, detection accuracy, and the like of the output part 61 and the input part 62. In this embodiment, the output part 61 outputs the ultrasonic wave having a frequency characteristic of 32 kHz (kilohertz).

The media sensor 60 of this embodiment is configured as described above, and detects a grammage of sheet conveyed by the conveyance roller pair 21. To be noted, the property of the sheet which the media sensor detects is not limited to the grammage, for example, surface properties (surface roughness, glossiness, and the like) are also acceptable.

The sheet fed by the sheet feeding unit 10 is detected by the sheet sensor 80 and the media sensor 60 while being conveyed by the conveyance roller pair 21 along the sheet conveyance path 2, and conveyed toward the transfer nip T that is an image formation position at which the toner image is formed. The sheet is further conveyed while the unfixed toner image is being transferred to a first surface (front surface) at the transfer nip T, and the toner image is fixed by being heated and pressed at the transfer nip F that is a fixing position at which the toner image is fixed. The sheet whose toner image has been fixed is further conveyed along the sheet conveyance path 2, and discharged to the sheet discharge tray 3 by the sheet discharge roller pair 22.

By repeating operations described above, the image forming apparatus 100 performs image formation on the sheet fed by the sheet feeding unit 10 in sequence. For example, the image forming apparatus 100 is capable of printing a monochromic image on the sheet at the conveyance speed of 230 mm/sec which is equivalent to about 43 sheets of A4 size (210 mm×297 mm) standard paper a minute. To be noted, the image forming apparatus is not limited to this, and it is acceptable that the image forming apparatus is capable of performing full color printing or multi color printing.

Further, in the image forming apparatus 100, an inverse conveyance path 7, serving as a second conveyance path, is formed so as to covey the sheet in a case where the image is formed on the second surface (back surface) opposite the first surface of the sheet. The inverse conveyance path 7 is formed in such a manner that branches from the sheet conveyance path 2 downstream of the fixing unit 40 in the sheet conveyance direction on the sheet conveyance path 2 and joins the sheet conveyance path 2 upstream of the conveyance roller pair 21 in the sheet conveyance direction on the sheet conveyance path 2. In other words, the inverse conveyance path 7 branches from the sheet conveyance path 2 downstream of the fixing unit 40 in the sheet conveyance direction, and joins the sheet conveyance path 2 upstream of the image forming unit 30 in the sheet conveyance direction.

In the case where the image is formed on the second surface (back surface) opposite the first surface of the sheet, a leading edge and a trailing edge of the sheet on which the toner image has been fixed on the first surface at the fixing nip F are switched by a switchback action which is performed by reversing the sheet discharge roller pair 22 with the sheet being nipped by the sheet discharge roller pair 22. The sheet whose leading and trailing edges have been switched is conveyed along the inverse conveyance path 7 by the inverse conveyance roller pairs 23 and 25 on the inverse conveyance path 7, and again conveyed along the sheet conveyance path 2 toward the transfer nip T by the conveyance roller pair 21.

The motor 50, serving as a driving unit, is a single motor driving the feed rollers 12, 15, and 16, each roller pair of the sheet conveyance apparatus 20, the photosensitive drum 33, the charge roller 35, the developing roller 36, the transfer roller 37, and the press roller 41. Therefore, each unit driven by the motor 50 is controlled synchronously with each other. Herewith, the image forming apparatus 100 of this embodiment is capable of miniaturizing the apparatus and suppressing cost, and, since it is not necessary to control acceleration and deceleration of a plurality of motors individually, also capable of reducing a processing load in the control unit 70. To be noted, it is acceptable to configure the image forming apparatus 100 in such a manner that it is possible to connect and disconnect a power from the motor 50 to and from each unit by a crutch mechanism, not shown. Further, it is acceptable to configure in such a manner that a motor driving the press roller 41 is independent from a motor driving the feed rollers 12, 15, and 16, each roller pair of the sheet conveyance apparatus 20, and the photosensitive drum 33.

Details of Fixing Unit

Next, with reference to FIG. 2, the details of the fixing unit 40 will be described. The fixing unit 40 includes the rotary member 42, the press roller 41, a heater 43, serving as a heating element, and a thermistor 45, serving as a temperature detection unit. The rotary member 42, for example, is formed in an endless belt shape (or cylindrical shape) by a heat resistance film having flexibility. The heater 43 is held by a heater holding member 46, and the heater holding member 46 is held by a metallic stay member 47. Pressing force is applied between the metallic stay member 47 and the press roller 41 by a pressing mechanism, not shown, and the fixing nip F is formed between the rotary member 42 and the press roller 41 by pressing the press roller 41 to the heater 43 via the rotary member 42.

Figure 2:
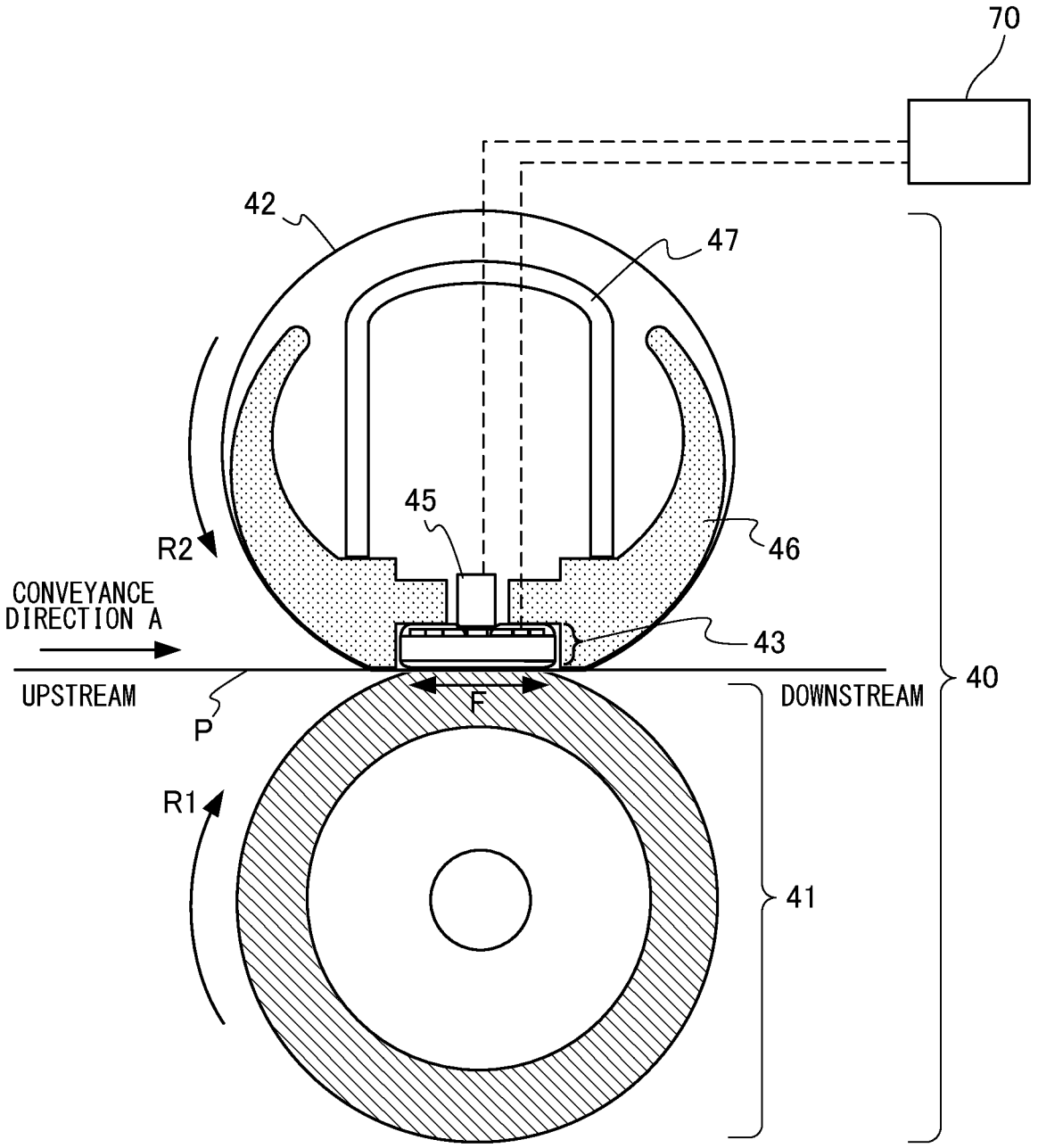
FIG. 2 is a cross-sectional view showing a fixing unit.

The rotary member 42 comes into pressure contact with the press roller 41, and rotates in an arrow R2 direction shown in FIG. 2 by friction force with the press roller 41 at the fixing nip F when the press roller 41 is rotatably driven in an arrow R1 direction shown in FIG. 2 by rotational driving force of the motor 50. The thermistor 45, serving as a temperature detection element, is disposed so as to come into contact with the heater 43, and outputs a signal corresponding to a temperature of the heater 43. Herewith, in the image forming apparatus 100, it is possible to predict a warming up degree (warming up state) based on an input signal transmitted from the thermistor 45. To be noted, the configuration of the fixing unit 40 is not limited to such a configuration in which the heater 43 directly comes into contact with the rotary member 42, and it is acceptable that the fixing unit 40 is configured in such a manner that the heater 43 indirectly comes into contact with the rotary member 42 via sheet material, such as iron alloy and aluminum, having high thermal conductivity.

Control Configuration

Figure 3:
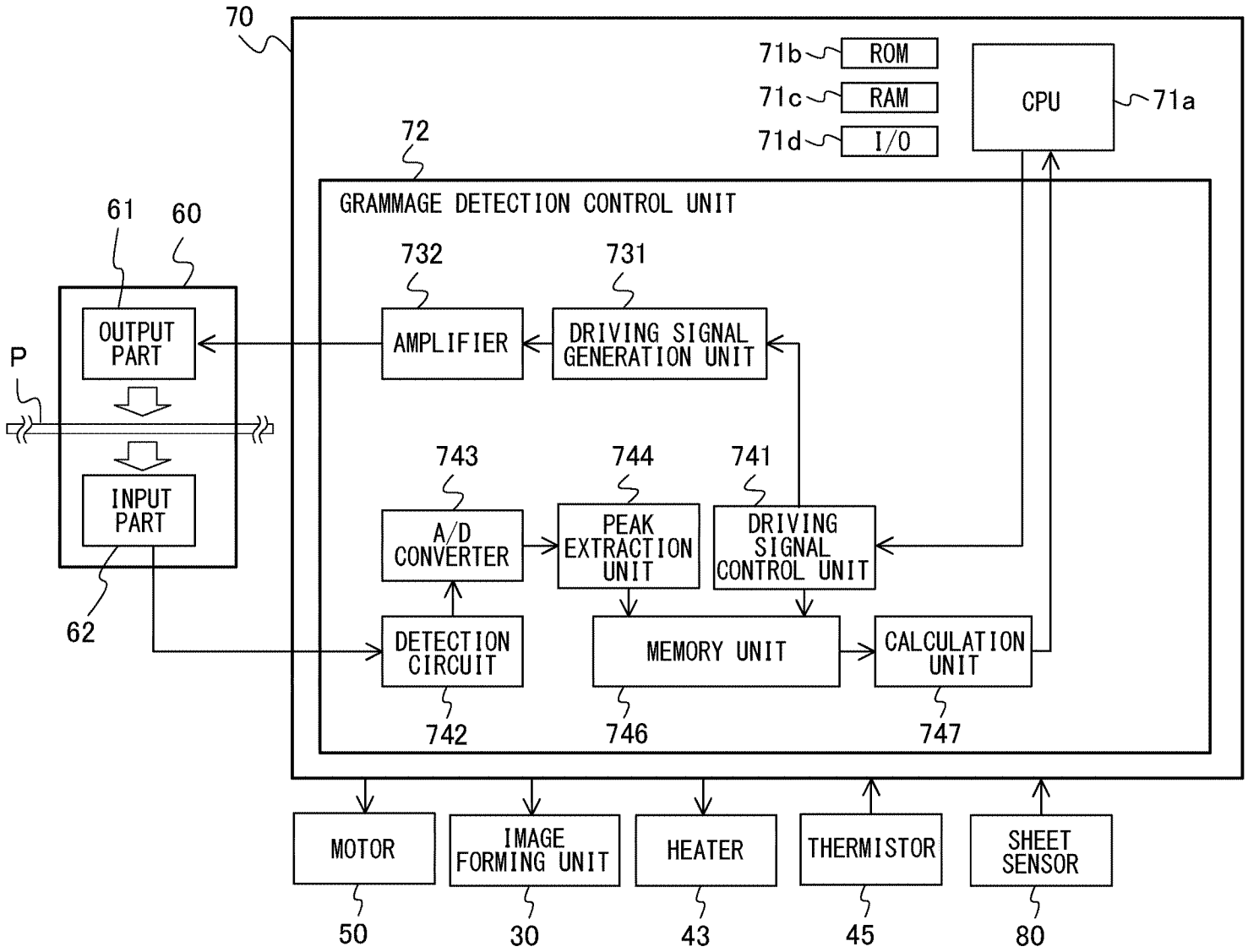
FIG. 3 is a block diagram showing a control configuration of the image forming apparatus.

FIG. 3 is a block diagram showing a control configuration of the image forming apparatus 100. The control unit 70 is configured by including hardware such as a CPU (central processing unit) 71*a*, a ROM (read-only memory) 71*b*, a RAM (random-access memory) 71*c*, I/O (input/output) 71*d*. The CPU 71*a* controls an operation of each part of the image forming apparatus 100 taking a part in the image formation by executing various programs stored in the ROM 71*b* while using the RAM 71*c* as a work area. These ROM 71*b* and the RAM 71*c* form a memory unit in the image forming apparatus 100 in this embodiment. To the control unit 70, signals from the sheet sensor 80, the input part 62 of the media sensor 60, the thermistor 45, an external apparatus, not shown, coupled to the I/O 71*d*, and the like are input. The control unit 70 controls the motor 50, the image forming unit 30, the heater 43, and the output part 61 of the media sensor 60 based on these input signals.

For example, the control unit 70 controls an electric current to the heater 43 so that the temperature of the fixing unit 40, namely, the temperature of the heater 43, detected by the thermistor 45 becomes a target temperature, described later, based on the input signal from the thermistor 45. Further, for example, the control unit 70 starts an image forming job to form the image on the sheet by operating the motor 50 and the image forming unit 30 based on the input signals (image formation instruction signal, feeding instruction signal).

Further, for example, the control unit 70 detects the leading edge of the sheet fed by the feed roller 12 based on the input signal from the sheet sensor 80, and adjusts a start timing of formation of the electrostatic latent image performed by the laser scanner 32 based on a detection timing of the leading edge of the sheet. For example, the control unit 70 controls the image forming unit 30 so that a leading edge of the toner image formed on the circumferential surface of the photosensitive drum 33 reaches the transfer nip T in a timing synchronizing with an arrival of the leading edge of the sheet at the transfer nip T.

Further, the control unit 70 detects (measures) the property of the sheet P, the grammage of the sheet P in this embodiment, based on the input signal from the input part 62 of the media sensor 60, and stores the detection result in the RAM 71*c*. In a case where the image forming apparatus 100 includes a plurality of sheet stacking units similar to this embodiment, the RAM 71*c* stores the detection result (property of the sheet) of the media sensor 60 for each of the sheet stacking units. While, in this embodiment, the image forming apparatus 100 includes two sheet stacking units of the feed cassette 11 and the manual feed tray 13, it is not limited to this. For example, it is acceptable that the image forming apparatus 100 includes a plurality of sheet stacking units, a plurality of manual feed trays, and an ADF (Auto Document Feeder) as the sheet stacking units and the RAM 71*c* stores the property of the sheet for each of the plurality of sheet stacking units.

Hereinafter, a configuration to detect the grammage of the sheet P by the media sensor 60 will be described. The control unit 70 includes a grammage detection control unit 72 performing input/output control of the ultrasonic wave and a process (hereinafter referred to as a grammage identification process) to identify the grammage of the sheet P. The control unit 70 controls image forming conditions (fixing conditions) at the image formation based on an arithmetic result at the grammage detection control unit 72. To be noted, the image forming conditions are conditions under which the image is formed on the sheet, and, for example, include the transfer voltage, the temperature of the heater 43 at fixing the toner image on the sheet (hereinafter also referred to as a fixing temperature or a temperature of the fixing unit 40), the sheet conveyance speed, and the like.

The CPU 71*a* of the control unit 70 outputs a signal indicating a start of measurement of the grammage of the sheet P to a driving signal control unit 741 of the grammage detection control unit 72. When the above signal is input from the CPU 71*a*, the driving signal control unit 741 instructs a driving signal generation unit 731 to generate an ultrasonic wave output signal so as to generate the ultrasonic wave of a predetermined frequency. The driving signal generation unit 731 outputs a fixed cycle pulse wave so as to enable the input part 62 to detect only a direct wave output by the output part 61 by reducing influence of disturbances such as reflected waves caused by the sheet P and members around the sheet conveyance path 2. This is called as a burst wave. In this embodiment, the driving signal generation unit 731 outputs five pulses of 32 kHz pulse waves repeatedly once a measurement. The driving signal generation unit 731 generates the signal of the predetermined frequency, and outputs to an amplifier 732. The amplifier 732 amplifies a level (voltage value) of the signal of the predetermined frequency input from the driving signal generation unit 731, and outputs to the output part 61. The piezoelectric element oscillates corresponding to the signal from the amplifier 732 so that the output part 61 outputs the ultrasonic wave.

The ultrasonic wave output by the output part 61 or the ultrasonic wave transmitted through the sheet P after output by the output part 61 is input to the input part 62, and the input part 62 outputs a signal corresponding to the input ultrasonic wave to a detection circuit 742 of the grammage detection control unit 72. The detection circuit 742 is capable of amplifying and rectifying the signal, and is capable of changing an amplification factor depending on absence and presence of the sheet P between the output part 61 and the input part 62. The detection circuit 742 amplifies and rectifies the input signal, and outputs to an A/D (analog/digital) converter 743. The A/D converter 743 converts the signal input from the detection circuit 742 from an analog signal to a digital signal, and outputs to a peak extraction unit 744. The peak extraction unit 744 extracts a peak (maximum value) of the input digital signal based on the digital signal input from the A/D converter 743, and stores the extracted peak value in a memory unit 746. These operations are called as a peak detection operation.

The peak detection operation is performed with a predetermined interval and for a predetermined number of times for each of states where the sheet P is absent and present between the output part 61 and the input part 62. Based on the peak value of the digital signals stored in the memory unit 746, a calculation unit 747 calculates a transmission coefficient of the ultrasonic wave through the sheet P from a ratio of an average of the peak values measured for the predetermined number of times in the state of the absence of sheet P to an average of the peak values measured for the predetermined number of times in the state of the presence of sheet P. The calculation unit 747 outputs the calculated transmission coefficient to the CPU 71*a*. The transmission coefficient calculated by the calculation unit 747 is a value having a negative correlation to the grammage of the sheet P, and the CPU 71*a* identifies the grammage of the sheet P based on the transmission coefficient calculated by the calculation unit 747.

To be noted, while the media sensor detecting the grammage of the sheet by the sound wave transmitting the sheet has been cited as an example of a means to detect the property of the sheet in this embodiment, it is not limited to this. As the means to detect the property of the sheet, it is acceptable to use a sensor which detects the property of the sheet by the sound wave reflected by the sheet and input to the input part. Further, it is acceptable to use a sensor which detects the property, such as material, thickness, surface property (surface roughness and glossiness), other than the grammage as the property of the sheet. Further, it is acceptable to use a sensor which detects a plurality of properties among these properties of the sheet.

Fixing Condition

Next, the fixing conditions in the image forming j ob which is performed by the control unit 70 of this embodiment will be described. The control unit 70 of this embodiment identifies (detects) the grammage of the sheet based on the detection result of the media sensor 60 (input signal from the media sensor 60), and determines the conditions at a time of fixing the toner image on the sheet (hereinafter referred to as fixing conditions) based on the identification result. For example, the fixing conditions include, among the image forming conditions described above, the temperature at a time of fixing the toner image on the sheet and the sheet conveyance speed at a time of passing through the fixing nip F.

Generally, appropriate fixing conditions differ depending on the property of the sheet. For example, in a case where the toner is fixed on the thick paper having a grammage larger than the standard paper, it is necessary to provide a heat quantity larger than the heat quantity provided in a case fixing the toner image on the standard paper. If the heat quantity provided at the time of the fixing of the toner image on the sheet is insufficient, a fixing defect not fixing the toner image on the sheet sufficiently is caused.

For example, while an increase in the temperature of the fixing nip F at the time of fixing the toner image is considered as a method to provide the more heat quantity to the toner image, so as to increase the temperature of the fixing nip F, a time required to heat the heater 43 is lengthened, and power consumption is increased. Further, for example, so as to provide the more heat quantity to the toner image, lengthening of a time for the sheet to pass through the fixing nip F by decreasing the sheet conveyance speed at the time of passing through the fixing nip F (hereinafter referred to as a fixing conveyance speed) is also considered as a method. However, if the fixing conveyance speed is decreased, a time required for the image formation is lengthened.

Therefore, in this embodiment, by changing the fixing conditions corresponding to the detection result of the media sensor 60, the control unit 70 enables a reduction of the power consumption and shortening of the time required for the image formation, along with suppressing the fixing defect. For example, in a case where it is judged that the sheet on which the image is formed is a large grammage sheet such as the thick paper, the control unit 70 changes the temperature of the fixing unit 40 so as to increase the temperature of the heater 43, and switches a rotational speed of the motor 50 so as to decrease the fixing conveyance speed.

In particular, as shown in FIG. 1, the control unit 70 of this embodiment identifies in which range of five ranges the grammage of the conveyed sheet is included. Then, the control unit 70 switches the conveyance speed between a first conveyance speed (high speed) at which the fixing conveyance speed of the sheet is 230 mm/sec and a second conveyance speed (low speed) at which the fixing conveyance speed of the sheet is 115 mm/sec. For example, the control unit 70 controls the rotational speed of the motor 50 so that the fixing conveyance speed of the sheet becomes the first conveyance speed in a case where the grammage of the sheet is equal to or more than 60 g/m$^2$ and less than 105 g/m$^2$ and becomes the second conveyance speed in a case where the grammage of the sheet is equal to or more than 105 g/m$^2$ and equal to or less than 199 g/m$^2$.

To be noted, while, in this embodiment, the control unit 70 is capable of switching the sheet conveyance speed by the sheet conveyance apparatus 20 between two conveyance speeds of the first conveyance speed and the second conveyance speed, it is not limited to this. It is acceptable that the control unit 70 is capable of changing the sheet conveyance speed among equal to or more than three conveyance speeds or capable of changing the sheet conveyance speed continuously. Further, in the image forming apparatus 100 of this embodiment, since the sheet feeding unit 10, the sheet conveyance apparatus 20, the image forming unit 30, and the fixing unit 40 are driven by the single motor of the motor 50, the fixing conveyance speed and the sheet conveyance speeds at the other parts are the same.

Further, the control unit 70 controls the fixing unit 40 in such a manner that the target temperature of the heater 43 becomes higher the larger the grammage of the sheet is within the range of the grammage of the sheet. In particular, the control unit 70 controls the fixing unit 40 in such a manner that the target temperature of the heater 43 becomes higher the larger the grammage of the sheet is within each of the ranges, namely, equal to or more than 60 g/m$^2$ and less than 105 g/m$^2$, and equal to or more than 105 g/m$^2$ and equal to or less than 199 g/m$^2$ of the grammage of the sheet. For example, in a case where the grammage of the sheet is a first value of equal to or more than 75 g/m$^2$ and less than 90 g/m$^2$, the control unit 70 sets the target temperature of the heater 43 higher than a case where the grammage of the sheet is a second value of equal to or more than 60 g/m$^2$ and less than 75 g/m$^2$.

TABLE 1

| GRAMMAGE ($g/m^2$) | CONVEYANCE SPEED (mm/sec) | TARGET TEMPERATURE (° C.) |
|---|---|---|
| EQUAL TO OR MORE THAN 60 AND LESS THAN 75 | 230 | 180 |
| EQUAL TO OR MORE THAN 75 AND LESS THAN 90 | | 190 |
| EQUAL TO OR MORE THAN 90 AND LESS THAN 105 | | 200 |
| EQUAL TO OR MORE THAN 105 AND LESS THAN 150 (THICK PAPER 1) | 115 | 170 |
| EQUAL TO OR MORE THAN 150 AND EQUAL TO OR LESS THAN 199 (THICK PAPER 2) | | 180 |

As described above, the control unit 70 optimizes the power consumption and the time required for the image formation depending on the grammage of the sheet by controlling the target temperature of the heater 43 and the rotational speed of the motor 50 corresponding to the grammage of the sheet. For example, in the image forming apparatus 100, in a case where the image formation is performed on the sheet conveyed at the first conveyance speed (high speed), a time required for the image formation of a sheet of an A4 size sheet, namely, a first print out time (hereinafter referred to as FPOT), is 7.0 sec. Further, for example, in the image forming apparatus 100, in a case where the image formation is performed on the sheet conveyed at the second conveyance speed (low speed), the FPOT is 12.0 sec.

Processes in Image Forming Job

Next, processes which the control unit 70 of this embodiment performs in the image forming job will be described. At a time of transferring the toner image to the sheet at the transfer nip T, it is necessary to synchronize a timing so that the toner image formed on the photosensitive drum 33 is transferred to a predetermined position on the sheet. In particular, after the sheet has been fed by the sheet feeding unit 10, the leading edge of the sheet is detected by the sheet sensor 80. In the image forming apparatus 100 described above, for example, the timing when the leading edge of the sheet reaches the transfer nip T is detected (calculated) from positions of the sheet sensor 80 and the transfer nip T and the sheet conveyance speed. On the other hand, an exposure to form the electrostatic latent image on the photosensitive drum 33 is performed in such a manner that the leading edge of the toner image on the photosensitive drum 33 also reaches the transfer nip T in the timing when the leading edge of the sheet reaches the transfer nip T. That is, in the timing of starting the exposure, it is necessary that a length between the leading edge of the electrostatic latent image and the transfer nip T in a circumferential direction of the photosensitive drum 33 and a length between the leading edge of the sheet and the transfer nip T are the same.

For example, in a case where the conveyance speed is too large or the target temperature is too low at a time of the detection of the grammage by the media sensor 60, a change to decrease the sheet conveyance speed after the detection of the grammage of the sheet by the media sensor 60 is considered as a method to suppress the fixing defect. However, changing a rotational speed of the photosensitive drum 33 after starting the exposure on the photosensitive drum 33 is not preferable in view of preventing occurrence of misalignment of the electrostatic latent image. Therefore, in the image forming apparatus 100 of this embodiment in which the photosensitive drum 33 and the sheet conveyance are driven by the single motor, it is necessary to complete changes in the sheet conveyance speed and the rotational speed of the photosensitive drum 33 before starting the exposure on the photosensitive drum 33. Therefore, the exposure of the photosensitive drum 33 is started in a timing taking into consideration a time required for the change in the speed after ending the detection of the grammage (property) of the sheet by the media sensor 60.

At this point, during the time when the change in the sheet conveyance speed is being performed, the sheet is conveyed on the sheet conveyance path 2. Therefore, as a length from a position, where the media sensor 60 ends the detection of the sheet, to the transfer nip T along the sheet conveyance path 2, it is necessary to secure a length which is obtained by adding a sheet conveyance length conveyed during the change of the speed to the length between the leading edge of the electrostatic latent image and the transfer nip T described above. That is, so as to perform the change in the sheet conveyance speed after the detection of the sheet by the media sensor 60, it is necessary to lengthen the sheet conveyance path to the transfer nip T by the sheet conveyance length conveyed during the change in the conveyance speed. Lengthening of the sheet conveyance path causes an increase in a size of the image forming apparatus.

Therefore, in this embodiment, the control unit 70 suppresses the fixing defect and improves the FPOT without changing the sheet conveyance speed after the detection of the sheet by the media sensor 60. Hereinafter, details of the control performed by the control unit 70 in the image forming job will be described.

In the image forming job, based on the detection result of the media sensor 60, the control unit 70 performs either of a first mode for the formation of the image on a small grammage sheet such as the standard paper and a second mode for the formation of the image on a large grammage sheet such as the thick paper. In other words, in the image forming job, the control unit 70 is capable of performing the second mode in a case where the property of the conveyed sheet is a predetermined property, and capable of performing the first mode in a case where the property of the conveyed sheet is other than the predetermined property above. In a case where the grammage of the sheet is less than a predetermined value, after detecting the grammage of the sheet by the media sensor 60, the control unit 70 performs the first mode in which the toner image is formed (transferred) on the sheet when the sheet passes through the transfer nip T for the first time, similar to a common image forming apparatus. In other words, in the first mode, after detecting the grammage of the sheet by the media sensor 60, the control unit 70 forms the toner image on the sheet when the sheet first passes through the transfer nip T.

In a case where the grammage of the sheet is equal to or larger than the predetermined value, after detecting the grammage of the sheet by the media sensor 60, the control unit 70 performs the second mode in which the toner image is not formed on the sheet when the sheet passes through the transfer nip T for the first time. Further, in the second mode, the control unit 70 conveys the sheet to the inverse conveyance path 7 after passing the sheet through the transfer nip T without forming the toner image. Further, in the second mode, the control unit 70 conveys the sheet to the sheet conveyance path 2 again via the inverse conveyance path 7, and forms the toner image on the sheet when the sheet is conveyed to the transfer nip T for the second time.

Herewith, even in a case where the grammage of the sheet is large, since it is possible to increase the fixing temperature to a temperature corresponding to the grammage of the sheet before the sheet is conveyed to the transfer nip T again via the inverse conveyance path 7, it is possible to suppress the fixing defect. Further, in the case where the grammage of the sheet is large, since the sheet passes through the fixing nip F twice, the sheet is easily warmed up, and it is possible to suppress the fixing defect.

Figure 4:
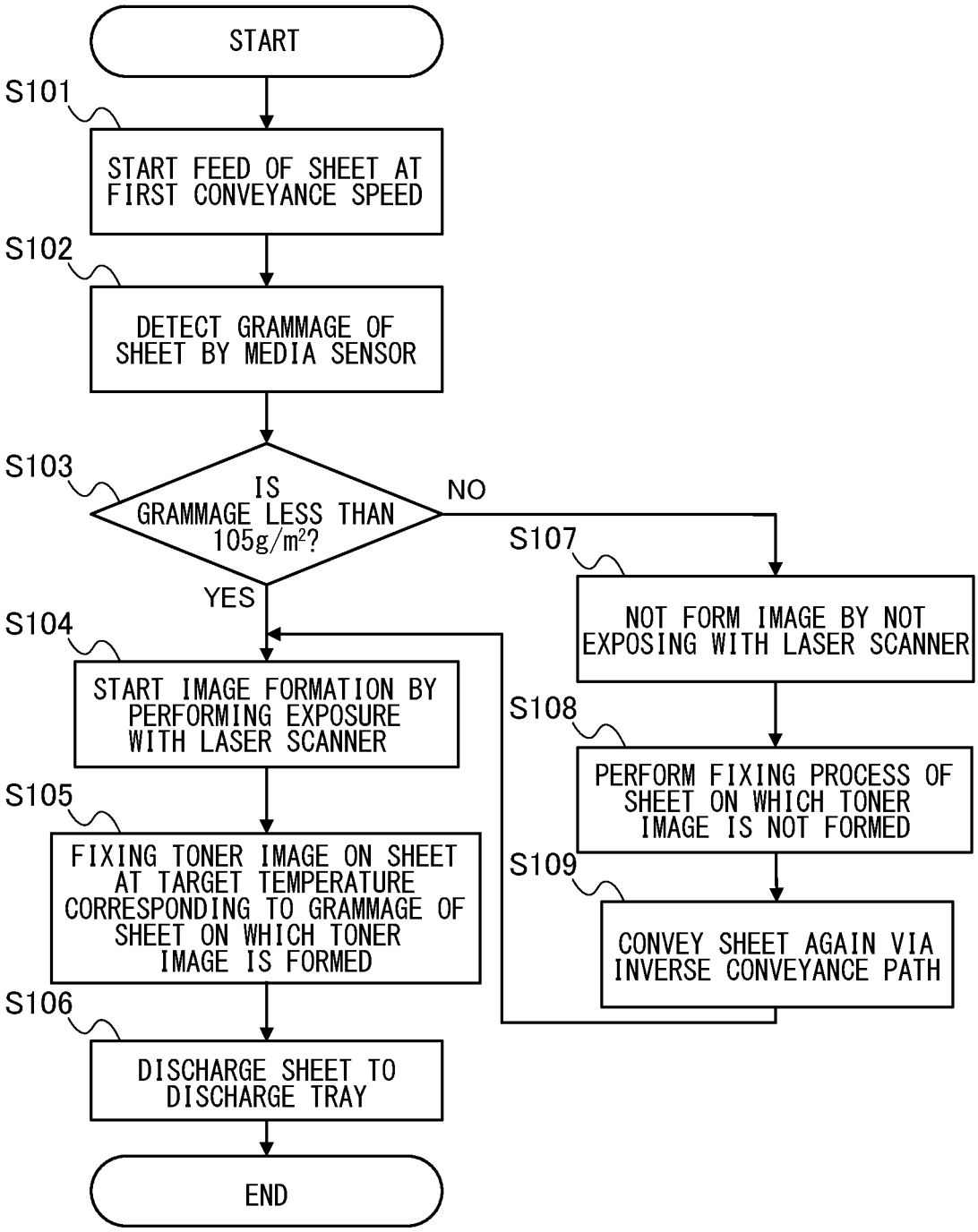
FIG. 4 is a flowchart showing an image forming job.

Hereinafter, with reference to FIG. 4, the details of the processes which the control unit 70 performs in this embodiment will be described.

When the image forming apparatus 100 has started the image forming job, the control unit 70 brings the sheet feeding unit 10 to start the feed of the sheet (conveyance of the sheet) at the first conveyance speed (high speed) (STEP S101). In this embodiment, in a state where the image forming job has been started, in other words, conveyance of the first sheet of the sheet of the image forming job (the first sheet) is started, the sheet conveyance speed and the target temperature of the heater 43 are respectively set at the first conveyance speed and 180° C. When the conveyance of the sheet has been started and the sheet is conveyed to the media sensor 60 by the conveyance roller pair 21, the media sensor 60 detects the grammage of the sheet, and outputs a signal corresponding to the grammage of the sheet to the control unit 70 (STEP S102).

When the signal from the media sensor 60 is input to the control unit 70, the control unit 70 judges whether or not the grammage of the sheet is less than 105 g/m$^2$ (STEP S103). In a case where the grammage is less than 105 g/m$^2$ at STEP S103 (STEP S103: YES), the control unit 70 starts to form the toner image on the sheet by bringing the laser scanner 32 to start the exposure of the photosensitive drum 33 (STEP S104). Further, in this process, in a case where the grammage of the sheet is equal to or more than 75 g/m$^2$ and less than 105 g/m$^2$, the control unit 70 changes the target temperature of the heater 43 to the target temperature corresponding to the grammage of the sheet shown in TABLE 1.

When the sheet reaches the fixing nip F with the toner image transferred at the transfer nip T, by the fixing unit 40, the control unit 70 fixes the toner image on the sheet at the fixing temperature corresponding to the grammage of the sheet (STEP S105). In other words, the control unit 70 performs a fixing process of the sheet, on which the toner image has been formed, at the fixing temperature corresponding to the grammage of the sheet. At this time, the target temperature of the heater 43 is set at the target temperature corresponding to the grammage of the detected sheet. In particular, the target temperature of the heater 43 is set at any one of values of 170° C., 180° C., 190° C., and 200° C. corresponding to the grammage of the detected sheet in accordance with TABLE 1. For example, in a case where the grammage of the sheet is equal to or more than 90 g/m$^2$ and less than 105 g/m$^2$, the control unit 70 changes the target temperature of the heater 43 from 180° C. to 200° C. The sheet whose toner image has been fixed by the fixing unit 40 is discharged onto the sheet discharge tray 3 by the sheet discharge roller pair 22 (STEP S106).

As described above, in the case where the grammage of the sheet is less than 105 g/m$^2$, at STEP S104, the control unit 70 performs the first mode forming the toner image on the sheet when the sheet passes through the transfer nip for the first time. In a case where the image forming job is a job in which the image formation is performed on a plurality of sheets in succession, when the image formation has ended on all of the sheets, the sheet conveyance speed and the target temperature of the heater 43 are respectively initialized to the first conveyance speed and 180° C.

Next, a case where the grammage of the sheet detected by the media sensor 60 is equal to or more than 105 g/m$^2$ at STEP S103 (STEP S103: NO) will be described. In this case, the sheet conveyance speed is preferably the second conveyance speed (low speed), and, if the fixing process is performed under the conditions of the first conveyance speed and the target temperature of the heater 43 at 180° C., there is a risk to cause the fixing defect of the toner image due to a significant shortage of the heat quantity provided to the toner image.

Therefore, the control unit 70 does not perform the formation of the toner image on the sheet when the sheet passes through the transfer nip T for the first time (STEP S107). In particular, the control unit 70 conveys the sheet along the sheet conveyance path 2 while maintaining the sheet conveyance speed at the first conveyance speed, and does not form the electrostatic latent image on the photosensitive drum 33 by bringing the laser scanner 32 not to expose the photosensitive drum 33. Herewith, since the toner image is not formed on the photosensitive drum 33, the toner image is not transferred to the sheet passing through the transfer nip T.

When the sheet passed through the transfer nip T reaches the fixing nip F, the control unit 70 passes the sheet through the fixing nip F by further conveying the sheet along the sheet conveyance path 2 (STEP S108). In other words, the control unit 70 performs the fixing process of the sheet on which the toner image is not formed. Since it is not necessary to maintain a high fixing temperature at this time, it is also possible to set the target temperature low to an extent not causing excessively large rotary torque of the rotary member 42 and the press roller 41. In this embodiment, the target temperature is set at 150° C.

When the trailing edge of the sheet has passed through the fixing nip F, the control unit 70 conveys the sheet to the inverse conveyance path 7 by bringing the sheet discharge roller pair 22 to rotate in reverse in a predetermined timing. Thereafter, the control unit 70 conveys the sheet toward the sheet conveyance path 2 again along the inverse conveyance path 7 by the inverse conveyance roller pairs 23 and 25 while maintaining the first conveyance speed (STEP S109).

When the sheet is conveyed along the sheet conveyance path 2 again by the conveyance roller pair 21, the control unit 70 starts forming the toner image on the sheet by bringing the laser scanner 32 to start the exposure of the photosensitive drum 33 (STEP S104). When the sheet has reached the fixing nip F with the toner image transferred at the transfer nip T, the control unit 70 fixes the toner image on the sheet by the fixing unit 40 while continuing to convey the sheet at the first conveyance speed (STEP S105). In this embodiment, the control unit 70 changes the target temperature of the heater 43 from a first temperature of 180° C. to a second temperature of 200° C., which is the highest temperature, in a predetermined timing between the first passage of the sheet through the fixing nip F and the second arrival of the sheet at the fixing nip F.

As described above, in the case where the grammage of the sheet is equal to or more than 105 g/m$^2$, at STEPS S107 to S109 and S104, the control unit 70 performs the second mode forming the toner image on the sheet when the sheet passes through the transfer nip T for the second time. When the sheet passes through the transfer nip T for the second time, while the fixing conveyance speed is larger than the fixing conveyance speed corresponding to the grammage of the sheet, the fixing temperature is higher than the fixing temperature corresponding to the grammage of the sheet. Further, when the sheet passes through the transfer nip T for the first time, the sheet has been already warmed up by the fixing unit 40, and is in a state where a temperature of the sheet is higher than a room temperature. Herewith, if the sheet is passed through the fixing nip F at the conveyance speed larger than the fixing conveyance speed corresponding to the grammage of the sheet, it is possible to provide a sufficient heat quantity to the toner image.

To be noted, in the case where the image formation is performed on the plurality of sheets of the sheet in succession, in a case where the grammage of a first sheet is equal to or more than 105 g/m$^2$, the grammages of the second and subsequent sheets of the sheet are more likely to be also equal to or more than 105 g/m$^2$. Therefore, in the case where the grammage of the first sheet is equal to or more than 105 g/m$^2$, the control unit 70 delays the feed of the second sheet of the sheet (second sheet) until such first sheet has been discharged, and starts the feed of the second and subsequent sheets of the sheet at the second conveyance speed after the discharge of the first sheet. At this time, after the first sheet has passed through the fixing nip F, the control unit 70 changes the target temperature of the heater 43 to either one of 170° C. and 180° C. corresponding to the grammage of the sheet shown in TABLE 1. Further, in the case where the grammage of the first sheet is equal to or more than 105 g/m$^2$, if the grammage of the second sheet is equal to or more than 105 g/m$^2$, the control unit 70 does not perform the second mode, and performs the image formation on the sheet under the fixing conditions corresponding to the grammage of the sheet.

Effect

With reference to TABLE 2, differences between configurations of this embodiment and prior art will be described. As a comparative example 1 of the prior art, an image forming apparatus which, at a time of forming the image on the first sheet by starting the image forming job, starts the conveyance of the sheet at the second conveyance speed (low speed) regardless of the grammage of the sheet is used. As a comparative example 2 of the prior art, an image forming apparatus which, if the sheet is the thick paper and the like and has the grammage of equal to or more than 105 g/m$^2$, forms the toner image on the sheet while maintaining the first conveyance speed when the sheet passes through the transfer nip T for the first time and fixes the toner image on the sheet without changing the conveyance speed is used. Other configurations of the comparative examples 1 and 2 are similar to the configuration of this embodiment.

To be noted, as the standard paper, HP Multipurpose Paper (trade name of Hewlett Packard Enterprise) (grammage 75 g/m$^2$) is used. Further, as the thick paper 1 (refer to TABLE 1), Premium Laser Print Paper (trade name of Hammermill, International Paper Company) (grammage 120 g/m$^2$) is used. Further, as the thick paper 2 (refer to TABLE 1), Springhill Cardstock Paper (trade name of Springhill, International Paper Company) (grammage 199 g/m$^2$) is used.

TABLE 2

| | FPOT OF STANDARD PAPER | FIXABILITY ON THICK PAPER 1 | FIXABILITY ON THICK PAPER 2 |
|---|---|---|---|
| FIRST EMBODIMENT | 7.0 sec | GOOD | ACCEPTABLE |
| COMPARATIVE EXAMPLE 1 | 12.0 sec | GOOD | GOOD |
| COMPARATIVE EXAMPLE 2 | 7.0 sec | NOT GOOD | NOT GOOD |

As shown in TABLE 2, since the image forming apparatus of the comparative example 1 fixes the toner mage on the sheet at the second conveyance speed (low speed), the fixing defect did not occur in a case where the image formation was performed on either one of the thick paper 1 and the thick paper 2 having the grammage of equal to or more than 105 g/m$^2$. However, in a case of the image formation on the standard paper having the grammage of less than 105 g/m$^2$, while it is possible to convey the sheet at the first conveyance speed only to suppress the fixing defect, since the sheet was conveyed at the second conveyance speed, which is a half of the first conveyance speed, the FPOT became 12.0 sec.

Since the image forming apparatus of the comparative example 2 fixes the toner mage on the sheet at the first conveyance speed regardless of the grammage of the sheet, the fixing defect occurred in the case where the image formation was performed on either one of the thick paper 1 and the thick paper 2.

On the other hand, the image forming apparatus 100 of this embodiment is capable of attaining the FPOT of 7.0 sec, and the fixing defect did not occur in the case where the image formation was performed on the thick paper 1. Further, in a case of the image forming apparatus 100 of this embodiment, while a minor fixing defect occurred in a case where a special image such as a photographic image and a full solid image was formed, a serious fixing defect did not occur.

As described above, in this embodiment, it is possible to control each of the conveyance roller pair 21, the photosensitive drum 33, the press roller 41, and the like at the same conveyance speed. Therefore, it is possible to reduce the processing load of the control unit 70 by simplifying the control of the motor without controlling the acceleration and the deceleration of a plurality of motors individually, and possible to suppress the fixing defect while improving productivity (FPOT).

Further, since it is possible to control each of the conveyance roller pair 21, the photosensitive drum 33, the press roller 41, and the like at the same conveyance speed, it is possible to drive these by the single motor of the motor 50, and the miniaturization of the apparatus and containment of the cost are enabled. Further, since it is possible to shorten the sheet conveyance path in comparison with a case where the conveyance speeds of the conveyance roller pair 21 and the photosensitive drum 33 are configured to be the same and the conveyance speed is changed after the detection of the sheet by the media sensor 60, it is possible to miniaturize the apparatus.

To be noted, while, in this embodiment, the control unit 70 performs the first mode in the case where the grammage of the sheet detected by the media sensor 60 is less than 105 g/m$^2$ and performs the second mode in the case where the grammage of the sheet is equal to or more than 105 g/m$^2$, it is not limited to this. For example, it is acceptable that the control unit 70 performs the second mode in the case where the grammage of the sheet is equal to or more than a value other than 105 g/m$^2$ and in a case where the property of the sheet other than the grammage is a predetermined property. Further, for example, it is acceptable that the control unit 70 performs the second mode in a case where at least one of the sheet conveyance speed and the target temperature of the heater 43 at a time of the detection of the property of the sheet by the media sensor 60 is not a value corresponding to the property of the detected sheet. Further, for example, it is acceptable that the control unit 70 performs the second mode without changing the target temperature of the heater 43 in a case where the property of the sheet is a predetermined property.

Further, while, in this embodiment, in the second mode, the control unit 70 restricts the formation of the toner image on the sheet by bringing the laser scanner 32 not to expose the photosensitive drum 33, it is not limited to this. For example, it is acceptable that the control unit 70 restricts the formation of the toner image on the sheet by bringing the toner image on the photosensitive drum 33 not to be transferred at the transfer nip T after the toner image has been formed on the photosensitive drum 33. In particular, it is acceptable that the control unit 70 brings the toner image on the sheet not to be transferred to the sheet by applying a transfer voltage of the same polarity as the toner to the transfer roller 37 at the transfer nip T.

Further, while, in this embodiment, when the image formation on all of the sheets has been ended, the control unit 70 initializes the sheet conveyance speed to the first conveyance speed and the target temperature of the heater 43 to 180° C., it is not limited to this. It is acceptable if the sheet conveyance speed and the target temperature are set at a predetermined conveyance speed and a predetermined target temperature at a start of the image forming j ob, and, for example, it is acceptable that the control unit 70 initializes the sheet conveyance speed and the target temperature at the start of the image forming job. Further, it is acceptable that the image forming apparatus includes an input apparatus, not shown, so that a user is able to set the predetermined sheet conveyance speed and the target temperature by operating the input apparatus at the start of the image forming job.

Further, while, in this embodiment, the control unit 70 determines the fixing conditions corresponding to the grammage of the sheet, it is not limited to this. It is acceptable if the control unit 70 determines the image forming conditions corresponding to a property of the sheet, and, for example, it is acceptable that the control unit 70 determines the transfer voltage at the transfer nip T corresponding to a property of the sheet detected by the media sensor 60.

Second Embodiment

Figure 5:
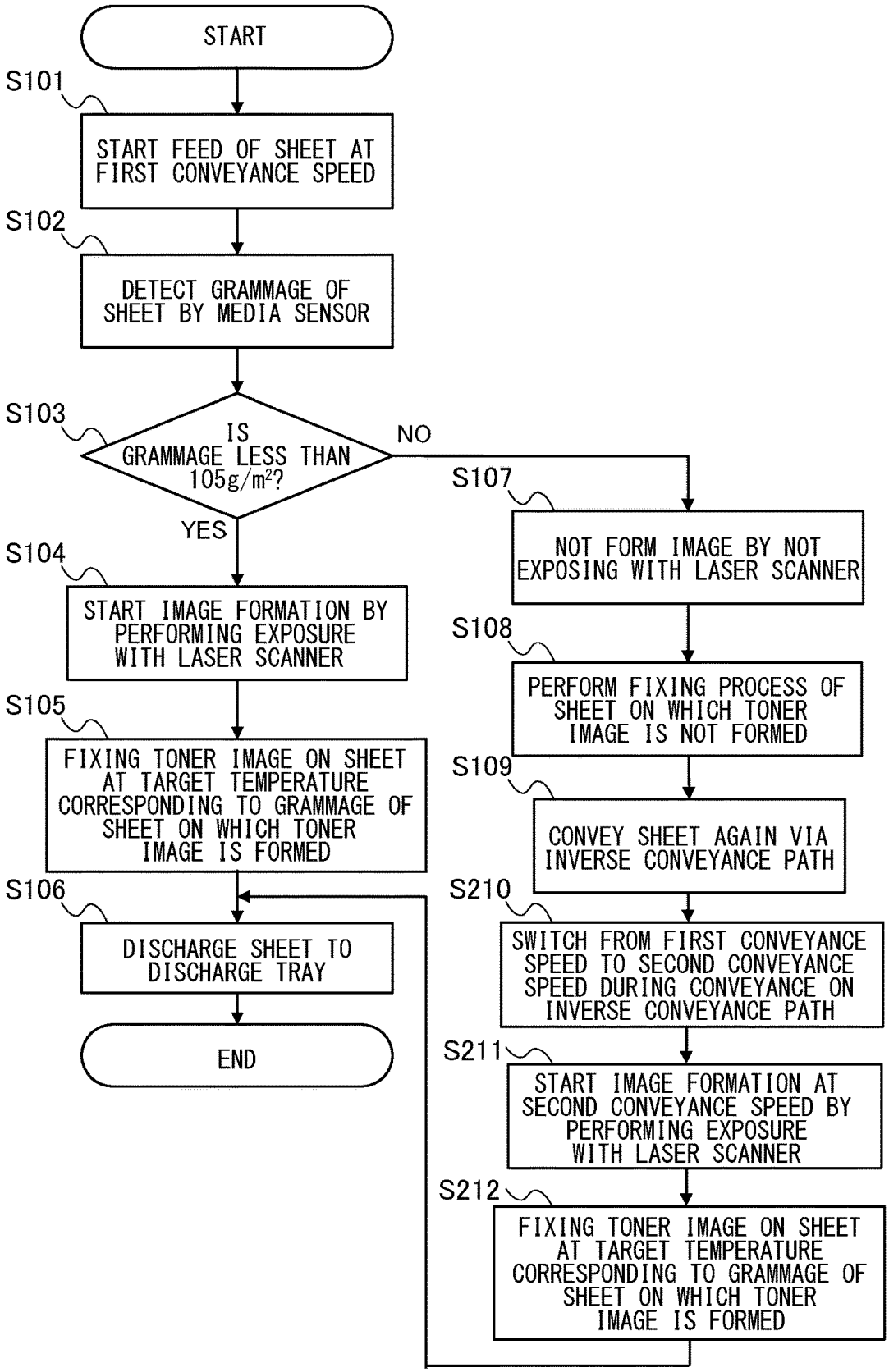
FIG. 5 is a flowchart showing an image forming job relating to a second embodiment.

Hereinafter, with reference to FIG. 5, a second embodiment will be described. The second embodiment is different from the first embodiment in processes of the image forming job which is performed by the control unit 70. In particular, in the second embodiment, in the case where the grammage detected by the media sensor 60 is equal to or more than 105 g/m$^2$, the control unit 70 performs a different process at STEP S103 of the image forming job in comparison with the first embodiment. Since other configurations are similar to the first embodiment, descriptions of configurations similar to the first embodiment will be omitted herein by putting the same reference characters on drawings.

In this embodiment, in the case where the grammage of the sheet is equal to or more than 105 g/m$^2$, the control unit 70 switches the sheet conveyance speed from the first conveyance speed (high speed) to the second conveyance speed (low speed) during a time when the exposure of the photosensitive drum 33 is not performed by the laser scanner 32. In particular, in the case where the grammage detected by the media sensor 60 at STEP S103 is equal to or more than 105 g/m$^2$ (STEP S103: NO), similar to the first embodiment, the control unit 70, at first, performs the processes of STEPS S107 to S109. In the process of STEP S109, the control unit 70 switches the sheet conveyance speed from the first conveyance speed to the second conveyance speed after the sheet has been conveyed to the inverse conveyance path 7 by the sheet discharge roller pair 22 and before the conveyance roller pair 21 starts conveying the sheet (STEP S210). In other words, the control unit 70 switches the sheet conveyance speed from the first conveyance speed (high speed) to the second conveyance speed (low speed) during a time when the sheet is conveyed along the inverse conveyance path 7 in the second mode.

Having switched the sheet conveyance speed, the control unit 70 starts forming the toner image on the sheet, while conveying the sheet at the second conveyance speed, by bringing the laser scanner 32 to start the exposure of the photosensitive drum 33 (STEP S211). Further, in the second mode, the control unit 70 sets the target temperature applied at a time when the sheet, on which the toner image has been formed, passes through the fixing nip F, that is, the target temperature applied at a time when the sheet passes through the fixing nip F for the second time, at either one of 170° C. and 180° C. corresponding to the grammage of the sheet shown in TABLE 1. Herewith, when the sheet passes through the fixing nip F for the second time, the control unit 70 fixes the toner image on the sheet at the fixing temperature corresponding to the grammage of the sheet (STEP S212). When the toner image has been fixed, the sheet is discharged to the sheet discharge tray 3 by the sheet discharge roller pair 22 (STEP S106).

Effect

Hereinafter, with reference to TABLE 3, differences among configurations of the first embodiment, the second embodiment, and comparative examples 1 and 2 of the prior art will be described. The comparative examples 1 and 2 are substantially similar to what are compared in the first embodiment.

TABLE 3

| | FPOT OF STANDARD PAPER | FIXABILITY ON THICK PAPER 1 | FIXABILITY ON THICK PAPER 2 |
|---|---|---|---|
| SECOND EMBODIMENT | 7.0 sec | GOOD | GOOD |
| FIRST EMBODIMENT | 7.0 sec | GOOD | ACCEPTABLE |
| COMPARATIVE EXAMPLE 1 | 12.0 sec | GOOD | GOOD |
| COMPARATIVE EXAMPLE 2 | 7.0 sec | NOT GOOD | NOT GOOD |

Since, in the second embodiment, also in the case where the grammage of the sheet is equal to or more than 105 g/m$^2$, it is possible to set the fixing conveyance speed and the target temperature corresponding to the grammage of the sheet, the fixing defect did not occur even in the case where the image formation is performed on the thick paper 2.

As described above, by this embodiment, it is possible to fix the toner image on the sheet at the conveyance speed and the target temperature corresponding to the grammage of the sheet, and possible to suppress the fixing defect while improving the FPOT.

Third Embodiment

Figure 6:
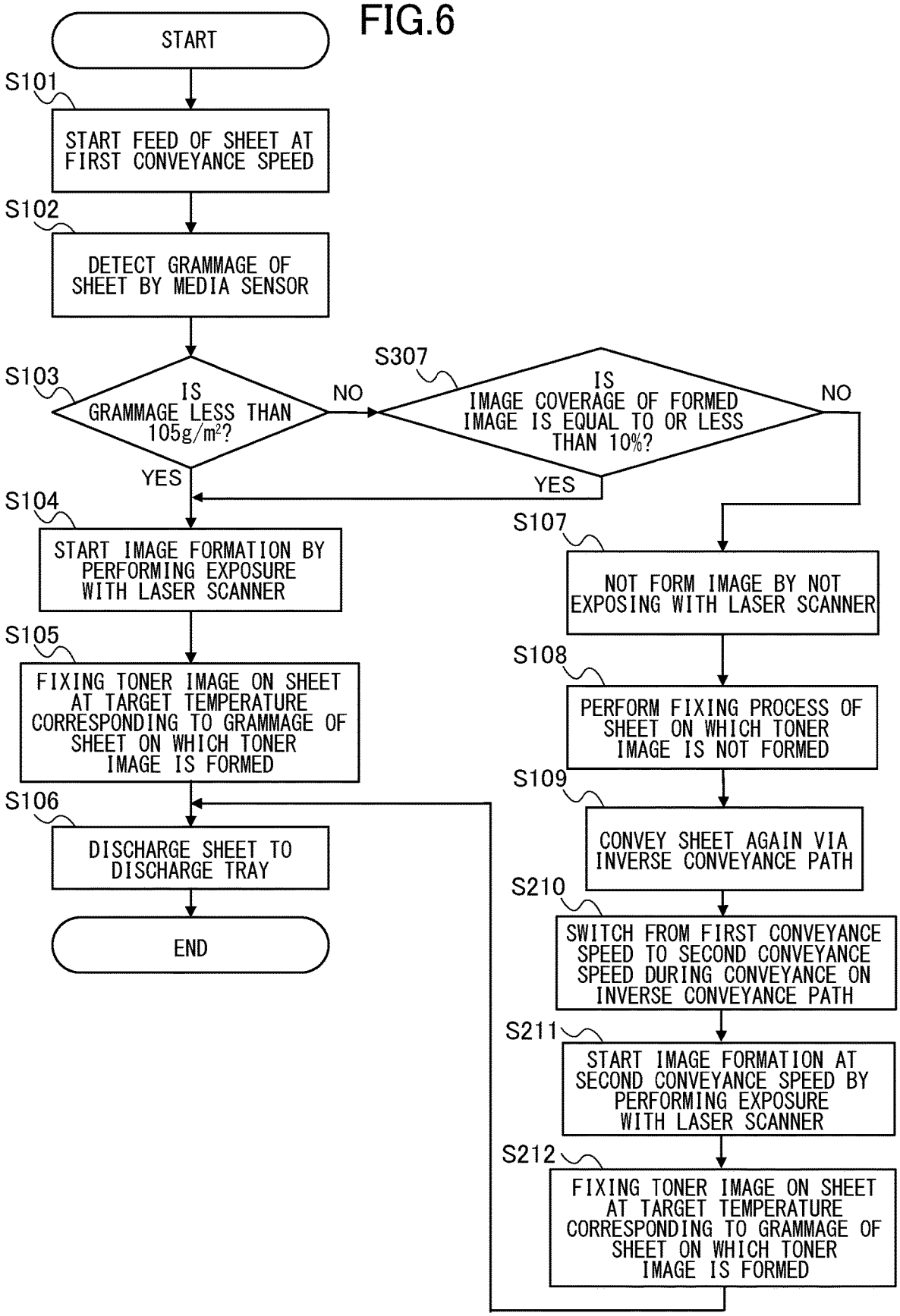
FIG. 6 is a flowchart showing an image forming job relating to a third embodiment.

Hereinafter, with reference to FIG. 6, a third embodiment will be described. The third embodiment is different from the second embodiment in processes of the image forming job which is performed by the control unit 70. In particular, in the third embodiment, in the case where the grammage detected by the media sensor 60 is equal to or more than 105 g/m$^2$, the control unit 70 performs a different process at STEP S103 of the image forming job in comparison with the second embodiment. Since other configurations are similar to the first embodiment, descriptions of configurations similar to the first embodiment will be omitted herein by putting the same reference characters on drawings.

Generally, even in a case where the grammage of the sheet is large, in a case where an image coverage formed on the sheet (image coverage) is small, the fixing defect hardly occurs even if the heat quantity provided to the sheet (toner image) is small. Therefore, in this embodiment, even in the case where the grammage of the sheet is equal to or more than 105 g/m$^2$, if the image coverage based on image information for the image formation input from the external apparatus and the like is less than a predetermined value, the control unit 70 performs the first mode. In particular, at STEP S103, in the case where the grammage of the sheet is equal to or more than 105 g/m$^2$, the control unit 70 calculates the image coverage based on the image information input from the external apparatus and the like, and judges whether or not the image coverage is equal to or less than 10% (STEP S307).

To be noted, the image coverage is a ratio between an area of a region where the toner image is actually formed and an area of an image formation region of the sheet, and is calculated by the control unit 70 based on image data input from the external apparatus. In particular, for example, in a case where the image coverage is 10%, the toner image is formed over a whole area of the image formation region of the sheet, and, in a case where the image coverage is 50%, the toner image is formed over a half area of the image formation region of the sheet.

In a process of STEP S307, in a case where the image coverage is more than 10% (STEP S307: NO), the control unit 70 performs the processes of STEPS S107 to S109 and S210 to S212 similar to the second embodiment. In a process of STEP S307, in a case where the image coverage is equal to or less than 10% (STEP S307: YES), the control unit 70 does not perform the second mode, and forms the toner mage on the sheet by performing the first mode while maintaining the first conveyance speed.

Effect

Hereinafter, with reference to TABLE 4, differences among configurations of the first to third embodiments and comparative example 1 of the prior art will be described. The comparative example 1 is substantially similar to what is compared in the first embodiment.

TABLE 4

| | | PERFORMING BOTH SIDES PASSING IN CASE OF THICK PAPER 1 AND 2 | | | |
|---|---|---|---|---|---|
| | FPOT OF STANDARD PAPER | IMAGE COVERAGE EQUAL TO OR LESS THAN 10% | IMAGE COVERAGE MORE THAN 10% | FIXABILITY ON THICK PAPER 1 | FIXABILITY ON THICK PAPER 2 |
| THIRD EMBODIMENT | 7.0 sec | NO | YES | GOOD | GOOD |
| SECOND EMBODIMENT | 7.0 sec | YES | YES | GOOD | GOOD |
| FIRST EMBODIMENT | 7.0 sec | YES | YES | GOOD | ACCEPTABLE |
| COMPARATIVE EXAMPLE 1 | 12.0 sec | NO | NO | GOOD | GOOD |

In the third embodiment, even in the case where the grammage of the sheet is equal to or more than 105 g/m$^2$, in a case where the image coverage is small and it is not necessary to perform the second mode, the image is formed on the sheet by performing the first mode at the first conveyance speed (high speed) without passing through the inverse conveyance path 7 (not performing both sides passing). In a case of the third embodiment described above, the fixing defect did not occur in either case of the image formation in which the image is formed on the thick paper 1 and the thick paper 2 (refer to TABLE 1) having the grammage of the sheet of equal to or more than 105 g/m$^2$.

As described above, by this embodiment, even in the case where the grammage of the sheet is large, in the case where the image coverage is small and it is not necessary to perform the second mode, the image is formed on the sheet by performing the first mode at the first conveyance speed. Herewith, it is possible to suppress the fixing defect while suppressing a decrease in the productivity (throughput) of the large grammage sheet. To be noted, while, in this embodiment, even in the case where the grammage of the sheet is large, in the case where the image coverage is smaller than a predetermined value, the control unit 70 forms the image on the sheet by performing the first mode at the first conveyance speed without performing the second mode, it is not limited to this. It is acceptable that, even in the case where the grammage of the sheet is large, the control unit performs the first mode at the first conveyance speed without performing the second mode based on the other image information. For example, it is acceptable that, even in the case where the grammage of the sheet is large, in a case where the maximum density of the toner image formed on the sheet is lower than a predetermined density, the control unit performs the first mode at the first conveyance speed without performing the second mode. Further, for example, it is acceptable that, even in the case where the grammage of the sheet is large, in a case where an average density, instead of the maximum density, or average brightness and the like of the image in an image forming apparatus capable of color printing is lower than a predetermined value, the control unit performs the first mode at the first conveyance speed without performing the second mode.

Fourth Embodiment

Hereinafter, with reference to FIGS. 7A and 7B, a fourth embodiment will be described. The fourth embodiment is different from the first embodiment in processes of the image forming job which is performed by the control unit 70. Since other configurations are similar to the first embodiment, descriptions of configurations similar to the first embodiment will be omitted herein by putting the same reference characters on drawings.

In the image forming job, at the time of forming the image on the first sheet, at first, the control unit 70 heats the fixing unit 40 by driving the fixing unit 40. After the temperature of the heater 43 has reached the target temperature, the control unit 70 further delays the feed of the sheet until a delay time tw, described later, has passed, and starts the feed of the sheet at the first conveyance speed. While conveying the sheet at the first conveyance speed (high speed), the control unit 70 brings the media sensor 60 to detect the property of the sheet, and stores the detection result, namely, the grammage of the sheet, in the RAM 71*c*, and forms the image on the sheet while conveying the sheet at the first conveyance speed. At a time of forming the image on the second and subsequent sheets of the sheet, at first, the control unit 70 heats the fixing unit 40 by driving the fixing unit 40. After the temperature of the heater 43 has reached the target temperature, the control unit 70 performs the image formation by conveying the sheet at the conveyance speed corresponding to the property of the sheet based on the detection result of the first sheet by the media sensor 60.

In other words, in the image forming job, when the sheet feeding unit 10 feeds the sheet, the control unit 70 judges whether or not the detection result of the sheet by the media sensor 60 is stored in the RAM 71*c*. Then, in a case where the detection result of the sheet, namely, the property of the sheet, is not stored in the RAM 71*c*, having delayed the start of the feed, the control unit 70 performs the image formation by conveying the sheet at the first conveyance speed. Further, in a case where the property of the sheet is stored, the control unit 70 performs the image formation by conveying the sheet at the conveyance speed corresponding to the property of the sheet.

Herewith, even in a case where the grammage of the first sheet of the image forming job is large, since a time before an arrival of the sheet at the fixing nip F is lengthened, it is possible to secure time to increase the temperature of the fixing nip F so that it becomes possible to suppress the fixing defect. To be noted, while, in the case where the detection result of the sheet is not stored in the RAM 71*c*, having delayed the start of the feed, the control unit 70 performs the image formation by conveying the sheet at the first conveyance speed (high speed), it is not limited to this. It is acceptable if, in the case where the detection result of the sheet is not stored in the RAM 71*c*, the control unit 70 is configured to perform, having delayed the start of the feed, the image formation by conveying the sheet at a conveyance speed faster than the slowest conveyance speed (such as the second conveyance speed mentioned above).

Hereinafter, with reference to FIGS. 7A and 7B, details of the processes performed by the control unit 70 in this embodiment will be described.

Figure 7A:
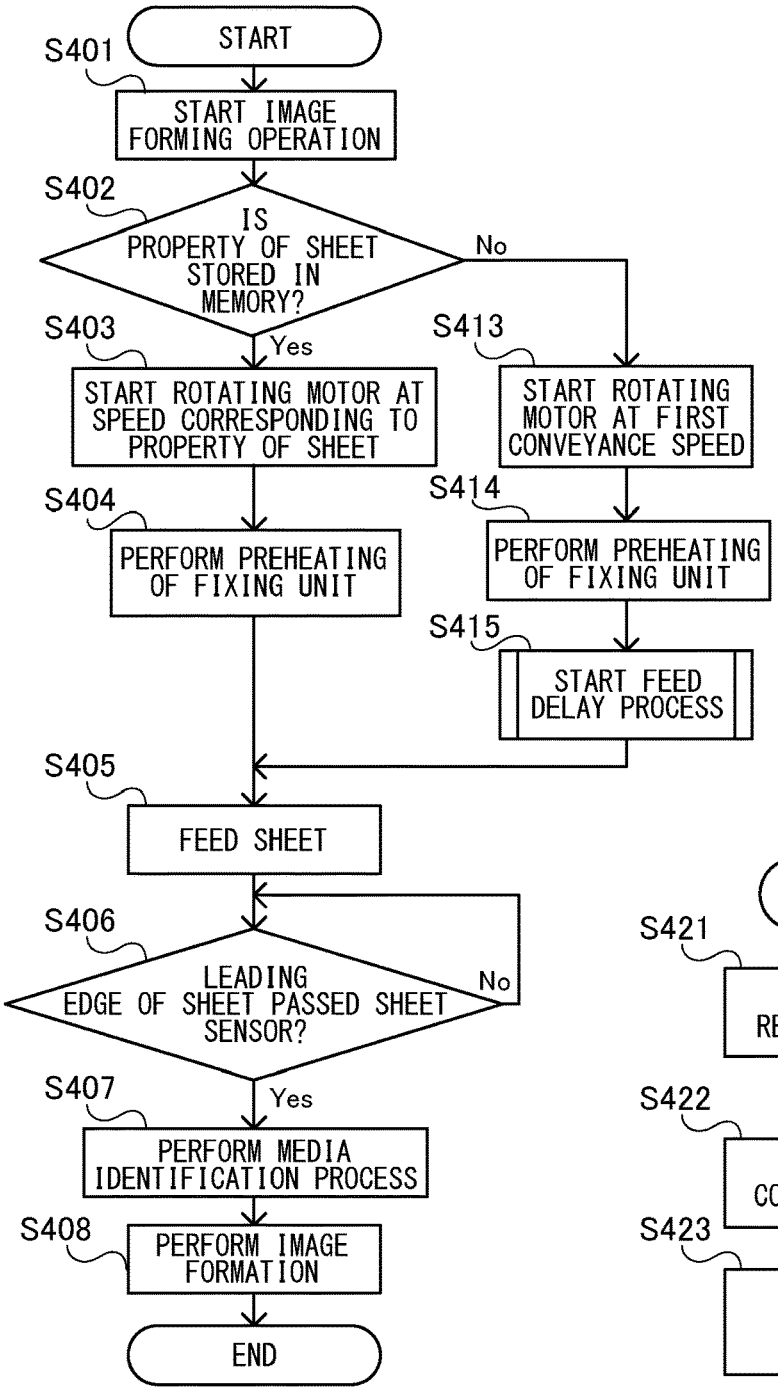
FIG. 7A is a flowchart showing an image forming job relating to a fourth embodiment.

As shown in FIG. 7A, when the control unit 70 receives an image formation instruction signal from the external apparatus, the control unit 70 starts the image forming job, and starts an image forming operation to form the image on the uppermost sheet of the sheet stacked in the sheet stacking unit specified by the received signal (STEP S401). When the image forming operation on the sheet is started, the CPU 71*a* of the control unit 70 judges whether or not the grammage (property) of the sheet corresponding to the sheet stacking unit specified by the image formation instruction signal is stored in the RAM 71*c* (STEP S402). For example, the case where the grammage of the sheet is not stored in the RAM 71*c* is a case where the image formation is performed only on one sheet of the sheet in the image forming operation of the image forming job, or a case where the image forming operation is on the first sheet in the image forming job in which the image is formed on a plurality of sheets in succession.

In the case where the grammage of the sheet is not stored in the RAM 71*c* at STEP S402 (STEP S402: NO), the control unit 70 starts the rotation of the press roller 41 by bringing the motor 50 to rotate so that the sheet conveyance speed becomes the first conveyance speed (high speed) (STEP S413). Further, the control unit 70 starts preheating the heater 43 (STEP S414) so that the heater 43 is heated to an initial value of the target temperature. In other words, at the first sheet of the image forming job, before starting the feed of the sheet by the sheet feeding unit 10, the control unit 70 heats the fixing unit 40 by driving the fixing unit 40 so that the fixing temperature becomes the predetermined fixing temperature regardless of the detection result of the media sensor 60. Further, at this time, regardless of the detection result of the media sensor 60, the control unit 70 heats the fixing unit 40 while driving the fixing unit 40 at a predetermined conveyance speed. In this embodiment, the initial value of the target temperature is 180° C. which is a fixing condition at a time of performing the image formation on the smallest grammage sheet. When the temperature of the heater 43 has reached the target temperature, the control unit 70 starts a feed delay process to delay the start of the feed of the sheet (STEP S415) while maintaining the rotational speed of the motor 50.

The feed delay process is a process to secure time to preheat the fixing unit 40 by providing a delay time (standby time) before the start of the feed of the sheet at STEP S405. By warming up the fixing unit 40 by securing an adequate preheating time with the feed delay process, even in a case where a fed sheet is the thick paper and the like, it becomes possible to provide an adequate heat quantity to the toner image when the sheet passes through the fixing nip F at the first conveyance speed.

Figure 7B:
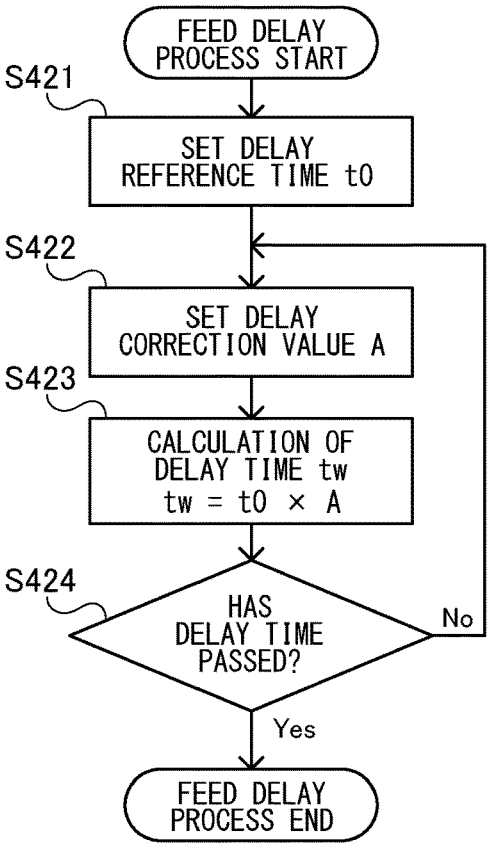
FIG. 7B is a flowchart showing a feed delay process relating to the fourth embodiment.

As shown in FIG. 7B, when the feed delay process has been started, at first, the control unit 70 sets a delay reference time t0 (STEP S421). The delay reference time t0 is a reference time of the delay time tw delaying the start of the feed, and is determined corresponding to conditions of the image forming apparatus 100. For example, the delay reference time t0 is determined corresponding to the temperature of the heater 43 based on the detection temperature of the thermistor 45 at the time of the start of the image forming operation at STEP S401 (or at the time of the start of the image forming job).

In particular, the lower the temperature of the fixing unit 40 is, the longer the control unit 70 sets the delay reference time so as to secure a longer preheating time. For example, in a case where the detection temperature of the thermistor 45 at the start of the image forming operation (image forming job) is a first temperature of lower than 38° C., the delay reference time t0 is set at longer than the delay reference time of a case where the detection temperature of the thermistor 45 is a second temperature of equal to or higher than 38° C. and lower than 55° C. In other words, in a case where the detection temperature of the thermistor 45 at the start of the image forming job is the second temperature whose difference from the target temperature is smaller in comparison with the first temperature, the control unit 70 set the delay reference time shorter. To be noted, while the delay reference time t0 is set corresponding to the temperature of the heater 43, it is not limited to this. For example, it is acceptable that, in a case where a temperature detection unit detecting a temperature of an inside of the apparatus body is disposed independently, the delay reference time t0 is set longer the lower the temperature of the inside of the apparatus body is.

TABLE 5

| DETECTION TEMPERATURE OF THERMISTOR | DELAY REFERENCE TIME t0 |
|---|---|
| LOWER THAN 38° C. | 4 sec |
| EQUAL TO OR HIGHER THAN 38° C. AND LOWER THAN 55° C. | 3 sec |
| EQUAL TO OR HIGHER THAN 55° C. AND LOWER THAN 95° C. | 2 sec |

TABLE 5-continued

| DETECTION TEMPERATURE OF THERMISTOR | DELAY REFERENCE TIME t0 |
|---|---|
| EQUAL TO OR HIGHER THAN 95° C. | 1 sec |

When the delay reference time t0 is set in the process of STEP S421, the control unit 70 sets a delay correction value A (STEP S422). The delay correction value A is a correction factor used to correct the delay reference time t0 by multiplying the delay reference time t0 at a time of determination of the delay time tw, and the delay time tw becomes shorter the smaller the delay correction value A is. In this embodiment, the delay correction value A is determined corresponding to the image coverage (printing rate) of image data at the time of forming the image on the sheet. The image coverage is the ratio between the area of the region where the toner image is actually formed and the area of the image formation region of the sheet, and is calculated by the control unit 70 based on the image data input from the external apparatus. For example, in the case where the image coverage is 100%, the toner image is formed over the whole area of the image formation region of the sheet, and, in the case where the image coverage is 50%, the toner image is formed over the half area of the image formation region of the sheet.

In this embodiment, the control unit 70 set the delay correction value A smaller the lower the image coverage is so as to shorten the delay time tw. For example, in a case where the image coverage is a first ratio of equal to or more than 5%, the control unit 70 sets the delay correction value A larger in comparison with a case where the image coverage is a second ratio of less than 2%. This is because it is possible to fix the image, having large area formed by a thin line, text, and the like and having a low image coverage, with a less quantity of the heat in comparison with the image having a high image coverage, such as the photographic image and the full solid image. In particular, the control unit 70 sets the delay correction value A corresponding to the image coverage of the image data in accordance with TABLE 6.

To be noted, depending on conditions of the image forming apparatus 100 and contents of the image data for the image formation, in some cases a calculation of the image coverage by the control unit 70 has not been completed at a time of STEP S422. In such a case, the control unit 70 sets the delay correction value A at 1.0 by taking into consideration a possibility that the image coverage based on the image data is equal to or more than 5%.

TABLE 6

| IMAGE COVERAGE | DELAY CORRECTION VALUE A |
|---|---|
| LESS THAN 2% | 0.6 |
| EQUAL TO OR MORE THAN 2% AND LESS THAN 5% | 0.8 |
| EQUAL TO OR MORE THAN 5% | 1.0 |

Having performed the process of STEP S422, the control unit 70 sets (calculates) the delay time tw based on the delay reference time t0 and the delay correction value A (STEP S423). In this process, the control unit 70 calculates a product of the delay reference time t0 and the delay correction value A (tw=t0×A) as the delay time tw. Since the control unit 70 calculates the delay time tw by multiplying the delay reference time t0 corresponding to the temperature of the heater 43 by the delay correction value A corresponding to the image coverage of the image data, securing of the preheating time longer than necessary is avoided, and the FPOT is shortened.

Having calculated the delay time tw, the control unit 70 compares a time passed from the start of the feed delay process, namely a time passed after the temperature of the heater 43 has reached the target temperature, with the delay time tw (STEP S424). In a case where the time passed from the start of the feed delay process is short of the delay time tw (STEP S424: NO), the control unit 70 returns the process to STEP S422.

As described above, in some cases the calculation of the image coverage by the control unit 70 has not been completed at the time of STEP S422. Therefore, in the case where the time passed from the start of the feed delay process is short of the delay time tw in the process of STEP S424, the control unit 70 returns the process to STEP S422 again, and overwrites the delay correction value A with the latest value.

On the other hand, in the process of STEP S424, in a case where the time passed from the start of the feed delay process has exceeded the delay time tw (STEP S424: YES), the control unit 70 ends the feed delay process. Having ended the feed delay process, as shown in FIG. 7A, while maintaining the rotational speed of the motor 50, the control unit 70 starts the feed of the sheet stacked in the sheet stacking unit specified by the image formation instruction signal (STEP S405). As described above, for the first sheet of the image forming job, the control unit 70 delays a start timing of the feed of the sheet by the sheet feeding unit 10 until the delay time tw described above has passed after the temperature of the fixing unit 40 reached the predetermined fixing temperature (target temperature).

Having started the feed of the sheet, the control unit 70 judges whether or not the leading edge of the sheet has passed through the sheet sensor 80 (STEP S406). In a case where the leading edge of the sheet has not passed through the sheet sensor 80 (STEP S406: NO), the control unit 70 holds the process, and, when the leading edge of the sheet passes through the sheet sensor 80 (STEP S406: YES), the control unit 70 performs a media identification process (STEP S407). In this process, based on the detection result of the media sensor 60, the control unit 70 identifies in which range of five ranges in TABLE 1 the grammage of the fed sheet is involved.

Having performed the process of STEP S407, the control unit 70 performs the image formation onto the sheet by forming the electrostatic latent image on the photosensitive drum 33, forming the toner image on the photosensitive drum 33, transferring the toner image to the sheet, and fixing the toner image on the sheet (STEP S408). At this time, while maintaining the sheet conveyance speed, the control unit 70 performs the image formation by changing the temperature of the heater 43 and the like other than the sheet conveyance speed (fixing conveyance speed) to the conditions corresponding to the grammage of the sheet identified at STEP S407. For example, the control unit 70 changes the target temperature of the heater 43 corresponding to the grammage of the sheet identified at STEP S407 in accordance with TABLE 7.

TABLE 7

| GRAMMAGE ($g/m^2$) | CONVEYANCE SPEED (mm/sec) | TARGET TEMPERATURE (° C.) |
|---|---|---|
| EQUAL TO OR MORE THAN 60 AND LESS THAN 75 | 230 | 160 |
| EQUAL TO OR MORE THAN 75 AND LESS THAN 90 | | 170 |
| EQUAL TO OR MORE THAN 90 AND LESS THAN 105 | | 180 |
| EQUAL TO OR MORE THAN 105 AND LESS THAN 150 | | 190 |
| EQUAL TO OR MORE THAN 150 AND EQUAL TO OR LESS THAN 199 | | 200 |

Herewith, for example, even in a case where the sheet having the grammage of 105 to 199 $g/m^2$ is conveyed at the first conveyance speed of 230 mm/sec, since the time required for increasing the temperature of the fixing nip F is secured by lengthening the time before the sheet reaches the fixing nip F, it is possible to suppress the fixing defect. Further, at a time of conveying the sheet having the grammage of 60 to 105 $g/m^2$, the target temperature of the heater 43 is decreased from the target temperature shown in TABLE 1 taking into consideration that the fixing unit 40 is warmed up by the feed delay process.

Further, the control unit 70 maintains the sheet conveyance speed corresponding to the grammage of the sheet identified at STEP S407 so that the misalignment of the electrostatic latent image caused by a change in the rotational speed of the photosensitive drum 33 at which the exposure is in progress is prevented. As described above, in the case where the grammage of the sheet is not stored in the RAM 71*c*, namely, in the case of the first sheet of the image forming job, the control unit 70 forms the image on the sheet while conveying the sheet at the first conveyance speed regardless of the detection result by the media sensor 60. In the case where the image forming job is the job in which the image formation is performed on the plurality of sheets in succession, the control unit 70 returns the process to STEP S401, and repeats the image forming operations of STEPS S401 to S408.

In the process of the second and subsequent sheets of the sheet in the image forming job to perform the image formation on the plurality of sheets in succession, at the time of the process of STEP S402, the grammage of the sheet has been already stored in the RAM 71*c* by the process of STEP S407 on the first sheet. In the case where the grammage of the sheet is stored in the RAM 71*c* (STEP S402: YES), the control unit 70 performs the image formation on the sheet under the most suitable fixing conditions corresponding to a value of the grammage.

In particular, the control unit 70 starts the rotation of the press roller 41 by rotating the motor 50 so that the sheet conveyance speed becomes the first conveyance speed or the second conveyance speed, slower than the first conveyance speed, corresponding to the grammage stored in the RAM 71*c* (STEP S403). Further, the control unit 70 starts to preheat the heater 43 so that, in accordance with TABLE 1, the temperature of the heater 43 becomes the temperature corresponding to the grammage stored in the RAM 71*c* (STEP S404). In other words, for the second sheet in the image forming job, before the start of the feed of the sheet by the sheet feeding unit 10, while driving the fixing unit 40, the control unit 70 heats the fixing unit 40 so that the fixing unit 40 becomes the fixing temperature corresponding to the property of the first sheet. Further, at this time, while driving the fixing unit 40 at the conveyance speed corresponding to the property of the first sheet detected by the media sensor 60, the control unit 70 heats the fixing unit 40.

When the temperature of the heater 43 has reached the target temperature, while maintaining the rotational speed of the motor 50, the control unit 70 starts the feed of the sheet stacked in the sheet stacking unit specified by the image formation instruction signal (STEP S405). As described above, for the second sheet in the image forming job, when the fixing unit 40 has reached the fixing temperature corresponding to the property of the first sheet, the control unit 70 starts the feed of the sheet by the sheet feeding unit 10.

Since the processes of STEPS S406 to S408 are similar to the processes for the first sheet, descriptions will be omitted herein. In this embodiment, when the image formation on all of the sheet in the image forming job has been ended, the sheet conveyance speed and the target temperature of the heater 43 are respectively initialized to the first conveyance speed (high speed) and 180° C.

Hereinafter, differences between configurations of this embodiment and the prior art will be described. As a comparative example 3 of the prior art, an image forming apparatus in which, in the case where the property of the sheet is not stored at the start of the image forming operation, the image formation is performed while conveying the sheet at the second conveyance speed (115 mm/sec) regardless of the fed sheet so as to suppress the fixing defect is used. Other configurations of the image forming apparatus of the comparative example 3 are similar to this embodiment.

In the comparative example 3, in the case where the property of the sheet is not stored at the time when the image forming operation is started, the image formation is performed while conveying the sheet at the second conveyance speed (low speed) regardless of the fed sheet so as to suppress the fixing defect. Therefore, in the comparative example 3, in the case where the property of the sheet is not stored at the time when the image forming operation is started, the FPOT becomes 12.0 sec regardless of the grammage of the sheet.

In this embodiment, for example, in a case where, at a time of STEP S401, the detection temperature of the thermistor 45 is lower than 38° C. and the image coverage is equal to or more than 5%, since the delay reference time t0 and the delay correction value A are respectively 4.0 sec and 1.0, the delay time tw becomes 4.0 sec (4.0×1.0=4.0). Further, since, in the case where the feed delay process is not performed, the FPOT at the first conveyance speed is 7.0 sec as described above, the FPOT becomes 11.0 sec by adding the delay time tw of 4.0 sec. This is shorter by 1.0 sec in comparison with the FPOT of the comparative example 3. Further, in a case where, at the time of STEP S401, the detection temperature of the thermistor 45 is equal to or higher than 38° C. or the image coverage is less than 5%, since the delay time tw becomes shorter than 4.0 sec, the FPOT is further shortened.

As described above, by this embodiment, it is possible to control each of the conveyance roller pair 21, the photosensitive drum 33, and the press roller 41 at the same conveyance speed. Therefore, it is possible to reduce the processing load of the control unit 70 by controlling the motor 50 with simple control without controlling the acceleration and the deceleration of the plurality of motors individually. Further, by this embodiment, for the second sheet in the image forming job, the control unit 70 performs the image formation under the image forming conditions corresponding to the property of the first sheet detected by the media sensor 60. Herewith, it is possible to form the image on the second sheet under the image forming conditions corresponding to the property of the first sheet, and possible to suppress the fixing defect.

Further, by this embodiment, with respect to the first sheet in the image forming job, the control unit 70 delays the start timing of the feed of the sheet by the sheet feeding unit 10 later than a start of a drive the fixing unit 40. Herewith, even in a case where the image is formed on the first sheet whose sheet property is not apparent, since it is possible to secure the time to increase the temperature of the fixing nip F in the fixing unit 40 by lengthening the time before the sheet reaches the fixing nip F, it is possible to suppress the fixing defect.

Further, by this embodiment, with respect to the first sheet in the image forming job, having delayed the start timing of the feed of the sheet by the sheet feeding unit 10 later than the start of the drive of the fixing unit 40, the control unit 70 starts the feed of the sheet at the first conveyance speed (high speed). Herewith, even in the case where the image is formed on the first sheet whose sheet property is not apparent, it is possible to shorten the FPOT and improve the productivity in comparison with a case where the sheet is conveyed at the second conveyance speed (low speed) without delaying the start timing of the feed of the sheet.

Further, by this embodiment, with respect to the first sheet in the image forming job, while conveying the sheet at the predetermined speed regardless of the property of the sheet, the control unit 70 forms the image on the sheet. Herewith, it is possible to shorten the sheet conveyance path and possible to miniaturize the apparatus in comparison with a case where the electrostatic latent image is formed on the photosensitive drum 33 after the conveyance speed has been changed subsequent to the detection of the property of the sheet.

Further, since it is possible to control each of the conveyance roller pair 21 and the photosensitive drum 33 at the same conveyance speed, it is possible to drive these by the single motor of the motor 50, and possible to miniaturize the apparatus and contain the cost. Further, since it is possible to shorten the sheet conveyance path, it is possible to miniaturize the apparatus in comparison with a case where the conveyance roller pair 21 and the photosensitive drum 33 are configured to convey the sheet at the same conveyance speed and configured to change the conveyance speed subsequent to the detection of the sheet by the media sensor.

To be noted, while, by this embodiment, when the image formation on all of the sheet in the image forming job has been ended, the control unit 70 respectively initializes the sheet conveyance speed and the target temperature of the heater 43 to the first conveyance speed and 180° C., it is not limited to this. It is acceptable if the sheet conveyance speed and the target temperature are set at a predetermined conveyance speed and a predetermined target temperature at the start of the image forming job, and, for example, it is acceptable that the control unit 70 initializes the sheet conveyance speed and the target temperature at the start of the image forming job. Further, it is acceptable that the image forming apparatus includes the input apparatus, not shown, so that the user is able to set the predetermined sheet conveyance speed and the target temperature by operating the input apparatus at the start of the image forming job.

Further, while, by this embodiment, the control unit 70 determines the fixing conditions corresponding to the grammage of the sheet, it is not limited to this. It is acceptable if the control unit 70 determines the image forming conditions corresponding to the property of the sheet, and, for example, it is acceptable that the control unit 70 determines the transfer voltage at the transfer nip T corresponding to the property of the sheet detected by the media sensor 60.

To be noted, it is also acceptable to set the delay reference time t0 corresponding to an installation environment of the image forming apparatus 100. For example, it is acceptable to set the delay reference time t0 such that the delay reference time t0 becomes larger the lower a temperature of the installation environment of the image forming apparatus 100 is. This is because, in a case where the installation environment of the image forming apparatus 100 is a low temperature, in some cases temperatures of the sheet and the toner are also low, and much larger quantities of the heat are required to fix the toner image in such cases.

Further, while, in this embodiment, the delay correction value A is set corresponding to the image coverage of the image data for forming the image on the sheet, it is not limited to this. For example, it is acceptable to set the delay correction value A corresponding to the maximum image density in a predetermined area of the fed sheet. In this case, it is possible to set the delay correction value A smaller the smaller the maximum image density is. For example, in a case where the maximum image density in the image forming area of the sheet is a first density, it is acceptable to set the delay correction value A larger in comparison with a case where the maximum image density is a second density which is smaller than the first density.

Fifth Embodiment

Hereinafter, with reference to FIGS. 8A and 8B, a fifth embodiment will be described. The fifth embodiment is different from the fourth embodiment in processes of the image forming job which is performed by the control unit 70. In particular, the fifth embodiment is different from the fourth embodiment in the process of STEP S402 of the image forming job in the case where the property of the sheet is not stored in the RAM 71*c*. Other configurations are similar to the fourth embodiment, and descriptions of the configurations similar to the fourth embodiment will be omitted herein by putting the same reference characteristics on drawings.

Generally, the rotary member 42 and the press roller 41 of the fixing unit 40 deteriorates in proportion to a cumulative number of rotations. Accordingly, so as to improve durability of the fixing unit 40, it is preferable to suppress the number of rotations of the rotary member 42 and the press roller 41. Therefore, in this embodiment, when the fixing unit 40 is preheated by rotating the press roller 41 in the case where the property of the sheet is not stored in the RAM 71*c*, the control unit 70 rotates the press roller 41 at the second conveyance speed, and switches over to the first conveyance speed before the start of the feed of the sheet. Herewith, in this embodiment, the durability of the fixing unit 40 is improved by suppressing the number of rotations of the press roller 41.

Figure 8A:
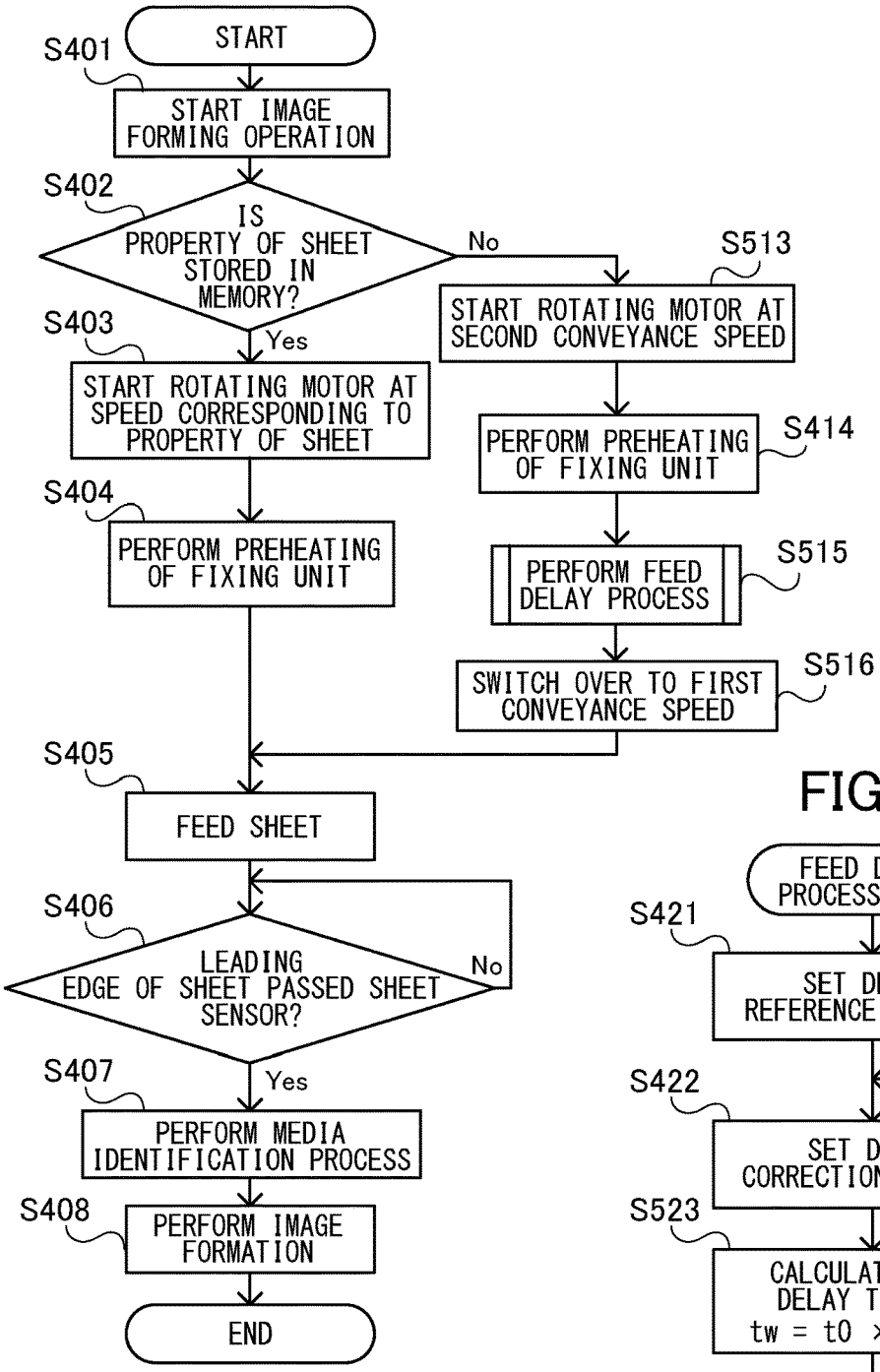
FIG. 8A is a flowchart showing an image forming job relating to a fifth embodiment.

In particular, as shown in FIG. 8A, in the case where the property of the sheet is not stored in the RAM 71*c* in the process of STEP S402 (STEP S402: NO), the control unit 70 starts the rotation of the press roller 41 so that the sheet conveyance speed becomes the second conveyance speed (STEP S513). As described above, with respect to the first sheet in the image forming job, before the start of the feed of the sheet by the sheet feeding unit 10, the control unit 70 drives the fixing unit 40 at the predetermined conveyance speed slower than the first conveyance speed which is the conveyance speed at the time of the image formation. Then, the control unit 70 of this embodiment starts to preheat the heater 43 so as to heat the fixing unit 40 to the initial value of the target temperature (STEP S414), and performs the feed delay process (STEP S515).

In this embodiment, a time (motor speed switching time t1) required for switching the rotational speed of the motor from the second conveyance speed (low speed) to the first conveyance speed (high speed) is 1.0 sec. By this embodiment, at the time of the calculation of the delay time tw in the feed delay process, the motor speed switching time t1 above is subtracted from the value obtained by multiplying the delay reference time t0 and the delay correction value A so that the FPOT of this embodiment becomes the same as the first embodiment.

Figure 8B:
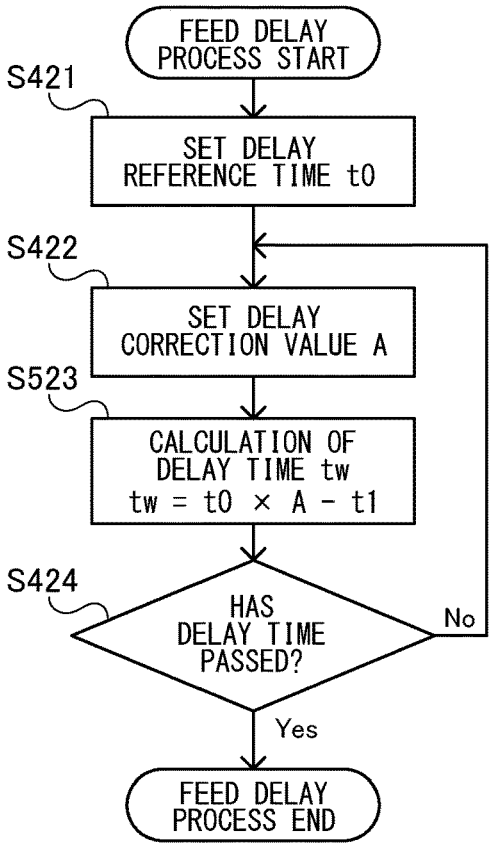
FIG. 8B is a flowchart showing a feed delay process relating to the fifth embodiment.

As shown in FIG. 8B, when the feed delay process has been started, similar to the fourth embodiment, the control unit 70 sets the delay reference time t0 (STEP S421) and the delay correction value A (STEP S422). Having performed the process of STEP S422, the control unit 70 calculates the delay time tw based on the delay reference time t0, the delay correction value A, and the motor speed switching time t1 (STEP S523). In this process, the control unit 70 calculates the delay time tw by subtracting the motor speed switching time t1 from the product of the delay reference time t0 and the delay correction value A ($tw=t0\times A-t1$).

Having calculated the delay time tw, the control unit 70 compares a time passed from the start of the feed delay process with the delay time tw (STEP S424). In a case where the time passed from the start of the feed delay process has exceeded the delay time tw (STEP S424: YES), the control unit 70 ends the feed delay process. Having ended the feed delay process, the control unit 70 switches the rotational speed of the motor 50 so that the sheet conveyance speed becomes the first conveyance speed (STEP S516), and starts the feed of the sheet stacked in the sheet stacking unit specified by the image formation instruction signal (STEP S405).

As described above, by this embodiment, when the fixing unit 40 is preheated by rotating the press roller 41 in the case where the property of the sheet is not stored in the RAM 71*c*, the control unit 70 rotates the press roller 41 at the second conveyance speed, and returns the rotational speed of the press roller 41 to the first conveyance speed before the start of the feed of the sheet. Herewith, by this embodiment, while improving the productivity, it is possible to improve the durability of the fixing unit 40 by suppressing the rotational speed of the motor 50 in a state not conveying the sheet. To be noted, by this, it is possible to also improve durability of the other parts (for example, the conveyance roller pair, the photosensitive drum, and the like) which are driven along with the drive of the fixing unit 40.

Sixth Embodiment

Hereinafter, with reference to FIGS. 9A and 9B, a sixth embodiment will be described. The sixth embodiment is different from the fifth embodiment in processes of the image forming job which is performed by the control unit 70. In particular, the sixth embodiment is different from the fifth embodiment in the process of STEP S402 of the image forming job in the case where the property of the sheet is not stored in the RAM 71*c*. Other configurations are similar to the fourth embodiment, and descriptions of the configurations similar to the fourth embodiment will be omitted herein by putting the same reference characteristics on drawings.

By this embodiment, even in the case where the property of the sheet is not stored in the RAM 71*c*, the control unit 70 judges whether or not to delay the start of the feed of the sheet depending on a situation, and, in a case not delaying the start of the feed of the sheet, while conveying the sheet at the second conveyance speed (low speed), forms the image on the sheet. In particular, in a case where the FPOT of the image formation at the second conveyance speed (low speed) without delaying the start of the feed of the sheet is shorter than the FPOT of the image formation at the first conveyance speed (high speed) after delaying the start of the feed of the sheet, the control unit 70 starts the sheet conveyance at the second conveyance speed without delaying the start of the feed of the sheet. Herewith, by this embodiment, it is possible to further shorten the FPOT in comparison with the fourth and fifth embodiments.

Figure 9A:
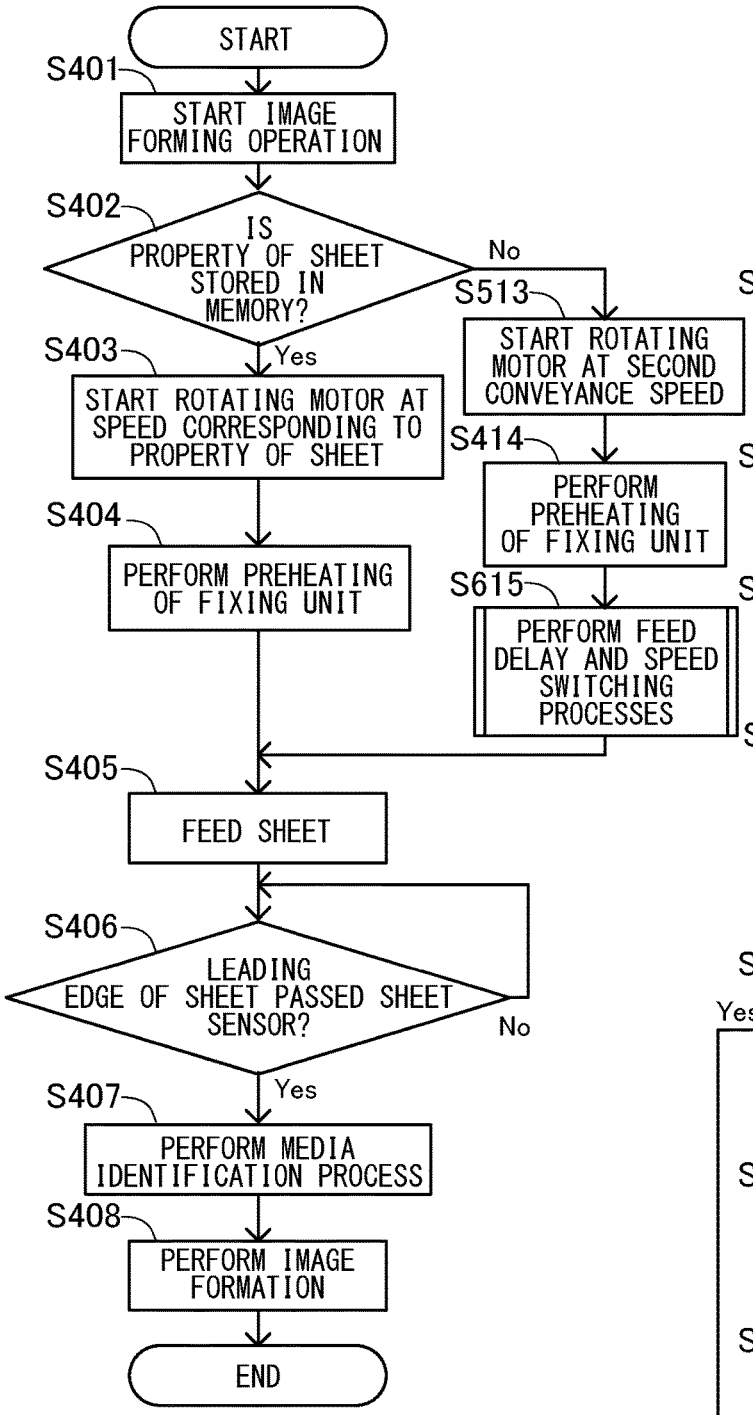
FIG. 9A is a flowchart showing an image forming job relating to a sixth embodiment.

As shown in FIG. 9A, when the preheating of the heater 43 to heat the fixing unit 40 to the initial value of the target temperature is started at STEP S414, the control unit 70 performs the feed delay process and a speed switching process (STEP S615).

Figure 9B:
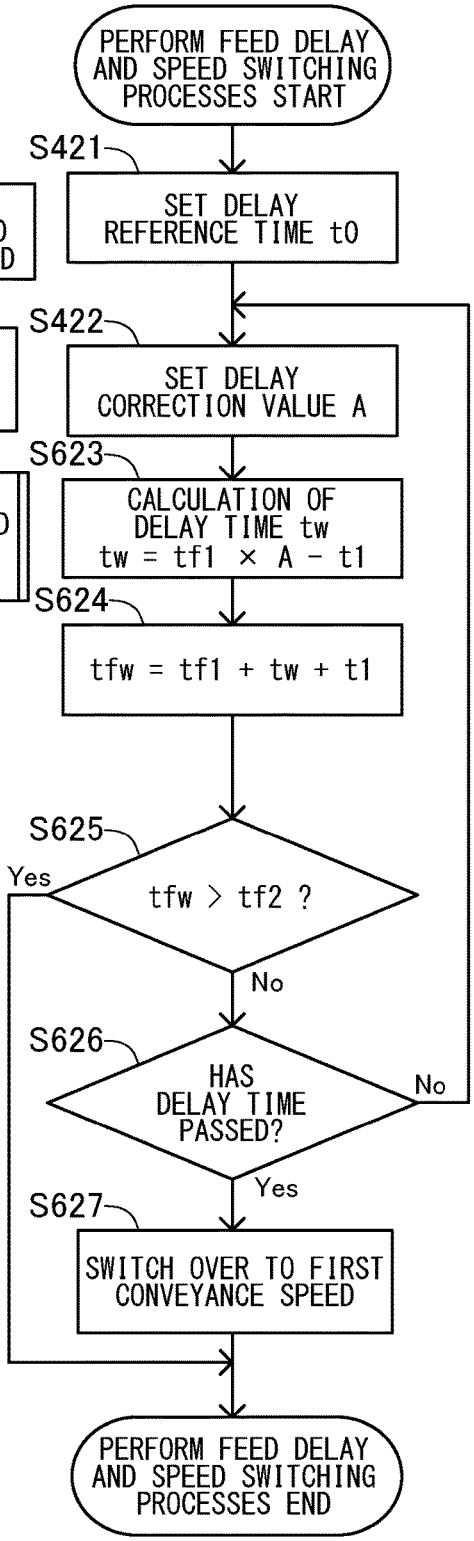
FIG. 9B is a flowchart showing a feed delay process relating to the sixth embodiment.

As shown in FIG. 9B, having started the feed delay process and the speed switching process, the control unit 70 sets the delay reference time t0 (STEP s421) and the delay correction value A (STEP S422), and calculates the delay time tw (STEP S623). By this embodiment, the delay reference time t0 is determined based on the detection temperature of the thermistor 45 in according with TABLE 8.

TABLE 8

| DETECTION TEMPERATURE OF THERMISTOR | DELAY REFERENCE TIME t0 |
|---|---|
| LOWER THAN 38° C. | 6 sec |
| EQUAL TO OR HIGHER THAN 38° C. AND LOWER THAN 55° C. | 5 sec |
| EQUAL TO OR HIGHER THAN 55° C. AND LOWER THAN 95° C. | 4 sec |
| EQUAL TO OR HIGHER THAN 95° C. | 3 sec |

Having calculated the delay time tw in the process of STEP S623, the control unit 70 calculates a FPOTtfw (a first time) of a case performing the image formation at the first conveyance speed (high speed) after delaying the start of the feed of the sheet (STEP S624). In this process, the control unit 70 calculates the FPOTtfw by adding up a FPOTtf1 of a case performing the image formation at the first conveyance speed without delaying the start of the feed of the sheet, the delay time tw, and the motor speed switching time t1 (tfw=tf1+tw+t1). In other words, the control unit 70 calculates the first time required before discharging the sheet in the case where the first sheet is conveyed at the first conveyance speed, faster than the second conveyance speed, with the delay time tw being set.

Having performed the process of STEP S624, the control unit 70 compares the FPOTtfw above with an FPOTtf2 (second time) of a case performing the image formation instantly at the second conveyance speed (low speed) without delaying the start of the feed of the sheet (STEP S625). In other words, the FPOTtf2 is a time required before discharging the sheet in the case where the first sheet of the sheet is conveyed at the second conveyance speed with the delay time tw not being set. In the process of STEP S625, if the FPOTtfw of the case performing the image formation at the first conveyance speed with delaying the start of the feed of the sheet is the smaller (STEP S625: NO), the control unit 70 compares a time passed from the start of the feed delay process with the delay time tw (STEP S626). In the process of STEP S626, if the time passed from the start of the feed delay process is short of the delay time tw (STEP S626: NO), the control unit 70 returns the process to STEP S422.

In the process of STEP S626, if the time passed from the start of the feed delay process has exceeded the delay time tw (STEP S626: YES), the control unit 70 switches the rotational speed of the motor 50 so that the sheet conveyance speed becomes the first conveyance speed (STEP S627). Having performed the process of STEP S627, the control unit 70 ends the feed delay process and the speed switching process. Having ended the feed delay process and the speed switching process, while maintaining the rotational speed of the motor 50, the control unit 70 starts the feed of the sheet stacked in the sheet stacking unit specified by the image formation instruction signal (STEP S405).

On the other hand, in the process of STEP S625, in a case where the FPOTtf2 of the case performing the image formation at the second conveyance speed instantly without delaying the start of the feed of the sheet is the smaller (STEP S625: YES), the control unit 70 ends the feed delay process and the speed switching process. Having ended the feed delay process and the speed switching process, as shown in FIG. 9A, while maintaining the rotational speed of the motor 50 so that the sheet conveyance speed becomes the second conveyance speed, the control unit 70 starts the feed of the sheet stacked in the sheet stacking unit specified by the image formation instruction signal (STEP S405). As described above, even in the case of the first sheet, in the case where the FPOT of the image formation at the second conveyance speed without delaying the start of the feed of the sheet is shorter than the FPOT of the image formation at the first conveyance speed after delaying the start of the feed of the sheet, the control unit 70 starts the sheet conveyance at the second conveyance speed without delaying the start of the feed of the sheet.

Hereinafter, differences between the configurations of the sixth and fifth embodiments will be described. For example, a case where the detection temperature of the thermistor 45 is lower than 38° C. and the image coverage is equal to or more than 5% at the time of STEP S401 is examined. In this case, in accordance with TABLE 8, the delay reference time t0 becomes 6.0 sec. Further, since the image coverage is equal to or more than 5%, the delay correction value A becomes equal to 1.0, and, since the motor speed switching time t1 is 1.0 sec, the delay time tw becomes 5.0 sec (6.0×1.0−1.0=5.0) in either of the fifth and sixth embodiments. Further, the FPOTtf1 of the case performing the image formation at the first conveyance speed without delaying the start of the feed of the sheet is 7.0 sec as described above. Therefore, the FPOTtfw of the case performing the image formation at the first conveyance speed after delaying the start of the feed of the sheet becomes 13.0 sec (tf1+tw+t1=7.0+5.0+1.0=13.0).

Further, the FPOTtf2 of the case performing the image formation at the second conveyance speed without delaying the start of the feed of the sheet is 12.0 sec as described above, and, under the conditions described above, is shorter than the FPOTtfw of the case performing the image formation at the first conveyance speed after delaying the start of the feed of the sheet. Therefore, under the conditions described above, the FPOT becomes 12.0 sec in either of the fifth and sixth embodiments, and there is not a difference in the FPOT.

Further, for example, a case where, at the time of STEP S401, the detection temperature of the thermistor 45 is lower than 38° C. and the image coverage is less than 2% is examined. In this case, in accordance with TABLE 8, similarly, the delay reference time t0 becomes 6.0 sec. Further, since the image coverage is less than 2%, the delay correction value A becomes equal to 0.6, and, since the motor speed switching time t1 is 1.0 sec, the delay time tw becomes 2.6 sec (6.0×0.6−1.0=2.6) in either of the fifth and sixth embodiments. Further, the FPOTtf1 of the case performing the image formation at the first conveyance speed without delaying the start of the feed of the sheet is 7.0 sec. Therefore, the FPOTtfw of the case performing the image formation at the first conveyance speed after delaying the start of the feed of the sheet becomes 10.6 sec (tf1+tw+t1=7.0+2.6+1.0=10.6).

Further, the FPOTtf2 of the case performing the image formation at the second conveyance speed without delaying the start of the feed of the sheet is 12.0 sec as described above. Therefore, under the conditions described above, the FPOT of the fifth embodiment becomes 12.0 sec, and the FPOT of the sixth embodiment becomes 10.6 sec. Accordingly, under the conditions described above, the FPOT of the sixth embodiment is shorter than the FPOT of the fifth embodiment by 1.4 sec. Further, in the sixth embodiment, since the image formation is performed while conveying the sheet at the second conveyance speed (low speed), it is possible to suppress the fixing defect.

As described above, by this embodiment, in the case where the FPOT of performing the image formation at the second conveyance speed without delaying the start of the feed of the sheet is shorter than the FPOT of performing the image formation at the first conveyance speed after delaying the start of the feed of the sheet, the control unit 70 starts the sheet conveyance at the second conveyance speed without delaying the start of the feed of the sheet. Herewith, by this embodiment, it becomes possible to further shorten the FPOT in comparison with the fourth and fifth embodiments, and possible to suppress the fixing defect while improving the productivity.

Other Embodiments

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD™, a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2020-121234, filed on Jul. 15, 2020 and Japanese Patent Application No. 2020-135964, filed on Aug. 11, 2020, which are hereby incorporated by reference herein in their entirety.

What is claimed is:

1. An image forming apparatus comprising:

a sheet conveyor configured to convey a sheet;

a first conveyance path on which the sheet is conveyed by the sheet conveyor;

a sheet property detecting sensor configured to detect a property of the sheet conveyed along the first conveyance path;

an image former configured to form an unfixed toner image onto the sheet detected by the sheet property detecting sensor at an image formation position on the first conveyance path, the image former comprising:

an image bearing member that rotates, a charge voltage applicator configured to charge the image bearing member by applying a charge voltage, an image bearing member exposer configured to form an electrostatic latent image by exposing the image bearing member which has been charged, an image developer configured to develop the electrostatic latent image on the image bearing member to a toner image, and a toner image transferor configured to transfer the toner image on the image bearing member to the sheet;

an image fixer configured to fix the toner image on the sheet by heating and pressing the sheet on which the toner image is formed by the image former;

a second conveyance path branching from the first conveyance path at a position downstream of the image fixer in a sheet conveyance direction and joining the first conveyance path at a position upstream of the image former in the sheet conveyance direction; and a controller including hardware configured to execute a first mode and a second mode, wherein the first mode is a mode in which a toner image is formed on a sheet at a time when the sheet passes through the image formation position for a first time after detecting the property of the sheet by the sheet property detecting sensor, wherein the second mode is a mode in which a toner image is not formed on a sheet at the time when the sheet passes through the image formation position for the first time after detecting the property of the sheet by the sheet property detecting sensor and is formed on the sheet at a time when the sheet is conveyed via the second conveyance path and passes through the image formation position for a second time, and wherein, in the second mode, the controller is configured to restrict transference of the toner on the image bearing member to the sheet by the toner image transferor by applying a voltage of a same polarity as the toner image to the toner image transferor.

2. The image forming apparatus according to claim 1, wherein, based on a detection of a predetermined property of the sheet by the sheet property detecting sensor, the controller is configured to change a fixing temperature of the image fixer from a first temperature to a second temperature different from the first temperature.

3. The image forming apparatus according to claim 2, wherein the second temperature is higher than the first temperature.

4. The image forming apparatus according to claim 1, wherein, based on a detection of a predetermined property of the sheet by the sheet property detecting sensor, the controller is configured to change select a sheet conveyance speed of the sheet conveyor from among a plurality of conveyance speeds including a first conveyance speed and a second conveyance speed, and wherein the second conveyance speed is slower than the first conveyance speed.

5. The image forming apparatus according to claim 1, further comprising a single motor configured to drive the sheet conveyor and the image former.

6. The image forming apparatus according to claim 1, wherein the sheet property detecting sensor is configured to detect at least one of a grammage and a surface property as the property of the sheet.

7. The image forming apparatus according to claim 1, wherein sheet property detecting sensor comprises an output part configured to output a sound wave to the sheet and an input part to which the sound wave is input.

8. The image forming apparatus according to claim 1, wherein, even in a case where the sheet property detecting sensor has detected that the property of the conveyed sheet is a predetermined property, the controller is configured to perform the first mode and not to perform the second mode in a case where an image coverage of the toner image formed on the sheet is less than a predetermined ratio.

9. The image forming apparatus according to claim 1, wherein, even in a case where the sheet property detecting sensor has detected that the property of the conveyed sheet is a predetermined property, the control unit controller is configured to perform the first mode and not to perform the second mode in a case where a maximum density of the toner image formed on the sheet is less than a predetermined density.

* * * * *